US008173219B2

(12) United States Patent
Tutin et al.

(10) Patent No.: US 8,173,219 B2
(45) Date of Patent: May 8, 2012

(54) POROUS FIBERGLASS MATERIALS HAVING REDUCED FORMALDEHYDE EMISSIONS

(75) Inventors: Kim Tutin, East Point, GA (US); Ramji Srinivasan, Alpharetta, GA (US); Natasha Wright, Stone Mountain, GA (US); Peter Boyer, Conyers, GA (US); Kurt Gabrielson, Lilburn, GA (US); Robert Fleming, Alpharetta, GA (US)

(73) Assignee: Georgia-Pacific Chemicals LLC, Atlanta, GA (US)

( * ) Notice: Subject to any disclaimer, the term of this patent is extended or adjusted under 35 U.S.C. 154(b) by 436 days.

(21) Appl. No.: 11/987,809

(22) Filed: Dec. 4, 2007

(65) Prior Publication Data

US 2008/0138526 A1 Jun. 12, 2008

Related U.S. Application Data

(63) Continuation-in-part of application No. 11/466,535, filed on Aug. 23, 2006, now abandoned, which is a continuation-in-part of application No. 11/478,980, filed on Jun. 30, 2006, now Pat. No. 7,989,367, application No. 11/987,809, which is a continuation-in-part of application No. 11/560,197, filed on Nov. 15, 2006, now abandoned, which is a continuation-in-part of application No. 11/450,488, filed on Jun. 9, 2006, now abandoned, application No. 11/987,809, which is a continuation-in-part of application No. 11/767,709, filed on Jun. 25, 2007, now abandoned, which is a continuation-in-part of application No. 11/688,892, filed on Mar. 21, 2007, now abandoned.

(51) Int. Cl.
*B05D 3/00* (2006.01)

(52) U.S. Cl. ..... 427/384; 427/248.1; 427/255.14; 427/332; 427/337; 427/340; 427/341; 427/385.5; 427/389.8; 427/407.3

(58) Field of Classification Search ..... None
See application file for complete search history.

(56) References Cited

U.S. PATENT DOCUMENTS

| | | | |
|---|---|---|---|
| 2,870,041 | A | 1/1959 | Waddle et al. |
| 3,108,990 | A | 10/1963 | Baxter |
| 3,912,836 | A | 10/1975 | Johansson |
| 3,957,431 | A | 5/1976 | Pai et al. |
| 3,983,094 | A | 9/1976 | O'Shea |
| 4,101,489 | A | 7/1978 | Reitz et al. |
| 4,101,498 | A | 7/1978 | Snyder |

(Continued)

FOREIGN PATENT DOCUMENTS

| | | | |
|---|---|---|---|
| DE | 2847975 | A | 5/1980 |

(Continued)

OTHER PUBLICATIONS

Abstracts and partial machine translation of JP 2005-194634, Jul. 21, 2005.*

(Continued)

*Primary Examiner* — Erma Cameron
(74) *Attorney, Agent, or Firm* — Michael S. Kerns; Ram W. Sabnis

(57) ABSTRACT

The present invention relates to formaldehyde scavenger treatments for porous fiberglass material having formaldehyde emitting binders thereon. The invention also relates to methods of making porous fiberglass material having reduced formaldehyde emissions.

12 Claims, 11 Drawing Sheets

U.S. PATENT DOCUMENTS 4,108,598 A 8/1978 Payet
4,127,382 A 11/1978 Perry
4,176,105 A 11/1979 Miedaner
4,255,102 A 3/1981 Smedberg et al.
RE30,860 E 2/1982 Swidler et al.
4,331,438 A 5/1982 Pai
4,342,610 A 8/1982 Ray, Jr.
4,346,181 A 8/1982 Allan
4,374,814 A 2/1983 Gaylord
4,376,807 A 3/1983 Cannon et al.
4,396,390 A 8/1983 Hendrix et al.
4,397,756 A 8/1983 Lehmann
4,409,375 A 10/1983 Hartman et al.
4,443,354 A 4/1984 Eian
4,458,049 A 7/1984 Diem et al.
4,472,165 A 9/1984 Gregorian et al.
4,501,628 A 2/1985 McGuire et al.
4,517,111 A 5/1985 Dorman et al.
4,547,350 A 10/1985 Gesser
4,678,686 A 7/1987 Park
4,753,746 A 6/1988 Mesmer et al.
4,757,108 A 7/1988 Walisser
4,892,719 A 1/1990 Gesser
5,108,798 A 4/1992 Guerro et al.
5,112,652 A 5/1992 Greene
5,160,679 A 11/1992 Greene
5,206,204 A 4/1993 Tsutsumi et al.
5,215,768 A 6/1993 Vinci et al.
5,231,063 A 7/1993 Fukumoto et al.
5,286,363 A 2/1994 Anderson et al.
5,296,584 A 3/1994 Walisser
5,318,802 A 6/1994 Ishikawa et al.
5,318,990 A 6/1994 Strauss
5,340,868 A 8/1994 Strauss et al.
5,358,748 A 10/1994 Mathews
5,362,784 A 11/1994 Brodie, III et al.
5,395,494 A 3/1995 Anderson et al.
5,409,769 A 4/1995 Fukumoto et al.
5,413,827 A 5/1995 Brodie, III et al.
5,530,048 A 6/1996 McDonald et al.
5,538,761 A 7/1996 Taylor
5,578,371 A * 11/1996 Taylor et al. ..... 442/327
5,603,927 A 2/1997 Fukumoto et al.
5,612,405 A 3/1997 Bainbridge
5,670,585 A 9/1997 Taylor
5,674,971 A 10/1997 Graves
5,684,118 A 11/1997 Breyer et al.
5,693,684 A 12/1997 Rader
5,698,108 A 12/1997 Okun
5,705,537 A 1/1998 Hartman, Jr. et al.
5,710,239 A 1/1998 Tutin
5,717,031 A 2/1998 Degen
5,719,228 A 2/1998 Taylor
5,846,603 A 12/1998 Miller
5,885,303 A 3/1999 Payet
5,942,323 A 8/1999 England
5,952,440 A 9/1999 Walisser
6,004,522 A 12/1999 England
6,024,775 A 2/2000 Miller et al.
6,132,870 A 10/2000 Halladay
6,136,058 A 10/2000 Miller
6,194,512 B1 2/2001 Chen
6,203,577 B1 3/2001 Yanai et al.
6,245,438 B1 6/2001 Dupre et al.
6,316,521 B1 11/2001 Disch et al.
6,395,819 B1 5/2002 Espiard
6,441,122 B1 8/2002 DeMott et al.
6,472,469 B2 10/2002 Bristol et al.
6,540,936 B1 4/2003 Takagi et al.
6,555,616 B1 4/2003 Helbing et al.
6,593,420 B1 7/2003 Helbing et al.
6,608,162 B1 8/2003 Chiu
6,638,882 B1 10/2003 Helbing et al.
6,646,094 B1 11/2003 Malhotra
6,706,808 B2 3/2004 Delaviz et al.
6,706,809 B2 3/2004 Tutin
6,723,670 B2 4/2004 Kajander et al.
6,749,949 B2 6/2004 Ljungar et al.
6,821,636 B2 11/2004 Ljungar et al.
6,827,746 B2 12/2004 Payet
6,861,099 B2 3/2005 Gabrielson et al.
6,881,814 B2 4/2005 Tang
6,893,579 B2 5/2005 Espiard
6,906,132 B2 6/2005 Belmares et al.
6,911,189 B1 6/2005 Koller et al.
6,933,349 B2 8/2005 Chen
8,043,383 B2 * 10/2011 Tutin et al. ..... 8/115.51
2001/0009945 A1 7/2001 Delaviz et al.
2003/0041735 A1 3/2003 Yoshikawa
2003/0099850 A1 5/2003 Belmares et al.
2003/0224119 A1 * 12/2003 Coventry-Saylor ..... 427/421
2003/0224120 A1 * 12/2003 Coventry-Saylor ..... 427/421
2004/0028876 A1 * 2/2004 Mizuno ..... 428/113
2004/0048531 A1 3/2004 Belmares et al.
2004/0131874 A1 7/2004 Tutin
2004/0250683 A1 12/2004 Soane et al.
2005/0161054 A1 7/2005 Sasaki et al.
2005/0236606 A1 10/2005 Toas et al.
2005/0279116 A1 12/2005 Park et al.
2006/0053824 A1 3/2006 Jung
2006/0057923 A1 3/2006 Jaffee
2006/0130451 A1 6/2006 Ding et al.
2006/0141121 A1 6/2006 Yoshikawa
2006/0222877 A1 10/2006 Khabbaz
2007/0173155 A1 7/2007 Shoemake et al.
2007/0287018 A1 12/2007 Tutin et al.
2008/0003346 A1 1/2008 Boyer et al.
2008/0003902 A1 1/2008 Boyer et al.
2008/0038971 A1 2/2008 Tutin et al.
2008/0118568 A1 5/2008 Smets et al.
2008/0233333 A1 9/2008 Tutin et al.
2008/0233334 A1 9/2008 Tutin et al.
2008/0286472 A1 11/2008 Tutin et al.
2009/0004391 A1 * 1/2009 Olang et al. ..... 427/385.5

FOREIGN PATENT DOCUMENTS

DE 4112296 A1 10/1991
JP 52-124999 A 10/1977
JP 53-009709 1/1978
JP 59147069 8/1984
JP 61-285973 12/1986
JP 10058588 A 3/1998
JP 10138205 A2 5/1998
JP 10195209 A 7/1998
JP 10296918 A 11/1998
JP 11-042741 A 2/1999
JP 11-114041 4/1999
JP 11-165379 A 6/1999
JP 11223023 A 8/1999
JP 11333813 A2 12/1999
JP 2000-301667 A 10/2000
JP 2001-178805 A 7/2001
JP 2002-273145 A 9/2002
JP 2003/001747 A 1/2003
JP 2004181045 A 7/2004
JP 2005125587 A 5/2005
JP 2007021929 A2 2/2007
WO WO 01/94436 A2 12/2001
WO 02/072324 A1 9/2002
WO WO 02/072323 A1 9/2002
WO 2004/039545 A1 5/2004
WO WO 2006/104455 A1 10/2006
WO 2007/082837 A1 7/2007

OTHER PUBLICATIONS

Southern Ionics, Inc. Sulfur Products Handbook (Brochure) Copyright 2004.

George Myers. Effects of Post-Manufacture Board Treatments on Formaldehyde Emission: A Literature Review (1960-1984). Forest Products Journal—1986, vol. 36, No. 6, pp. 41-51.

I. Andersen, G. R. Lundqvist and L. Molhave. The Effect of Air Humidity and Sulphur Dioxide on Formaldehyde Emission from a Construction Material (Chipboard). Holzforschung und Holzverwertung 28 (1976) 5, pp. 120-121.

N. Minemura, S. Imura, S. Hirata and H. Takahashi, Research on the Deodorization of Urea Resin-Bonded Plywood. Hokkaido Forest Products Research Institute. Research Report #65, Jun. 1976, pp. 53-87. Translation pagination: pp. 1-57.
ASTM Designation: C 665-91. Standard Specification for Mineral-Fiber Blanket Thermal Insulation for Light Frame Construction and Manufactured Housing. Published Nov. 1991. pp. 251-255.
PCT International Search Report, PCT/US2007/069941, Jul. 30, 2008, European Patent Office.
PCT International Search Report, PCT/US2007/071987, Jul. 30, 2008, European Patent Office.
PCT International Search Report and Written Opinion for PCT/US2008/066505, mailed Sep. 23, 2008, 8 pages, European Patent Office, Rijswijk, Netherlands.
Walker, J. Frederic, Formaldehyde, 1964, pp. 250-253, 486-487 and 620-623, Reinhold Publishing Corporation, New York, New York, USA.
European Patent Office, PCT International Search Report and Written Opinion for PCT/US07/69923 mailed Jun. 10, 2008, seven pages, Rijswijk, Netherlands.
European Patent Office, Written Opinion for PCT/US2007/069941 mailed Jul. 30, 2008, seven pages, Rijswijk, Netherlands.
European Patent Office, Written Opinion for PCT/US2007/071987 mailed Jul. 30, 2008, seven pages, Rijswijk, Netherlands.

* cited by examiner

FIGURE 6: EXAMINATION OF HANDSHEET STRENGTH AS A FUNCTION OF FORMALDEHYDE SCAVENGER ADDITION POINT
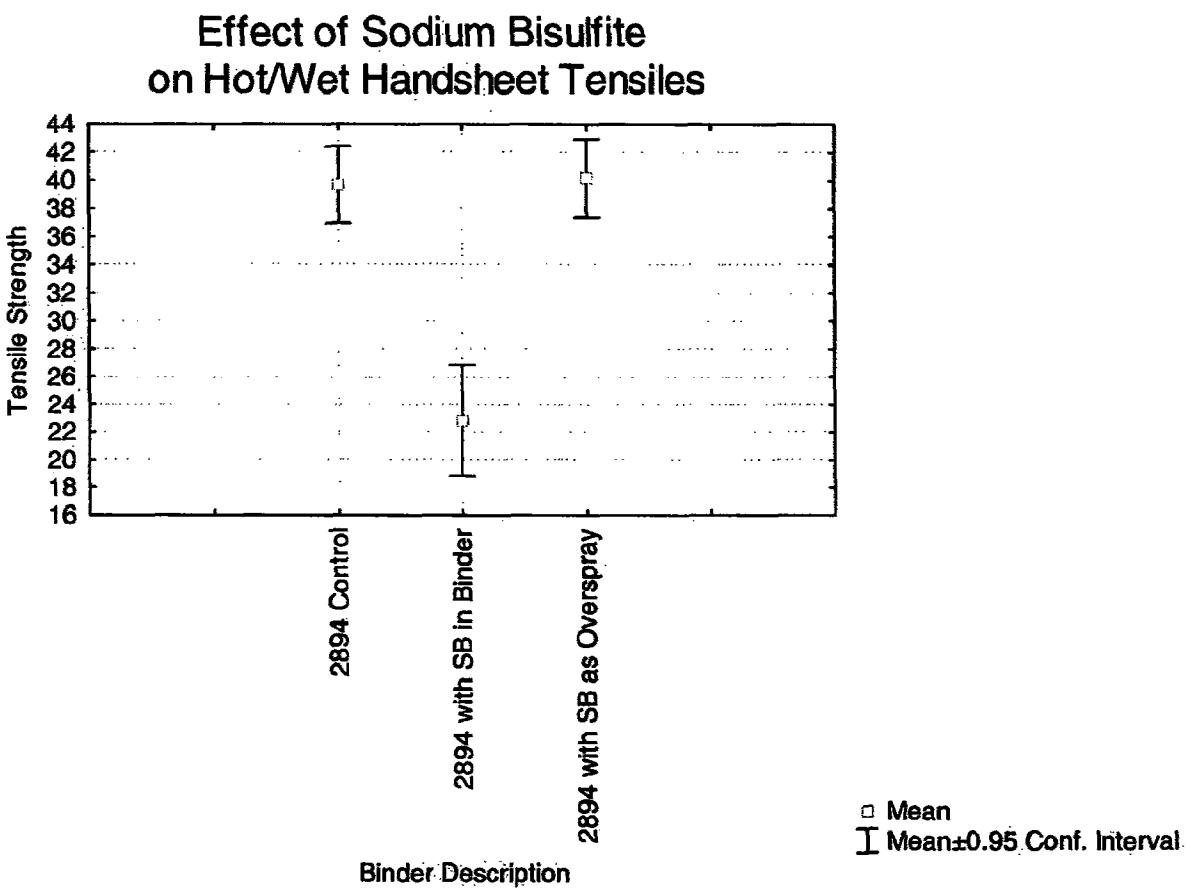

FIGURE 7: BISULFITE SHEET TREATMENT ON R-13 EMISSIONS
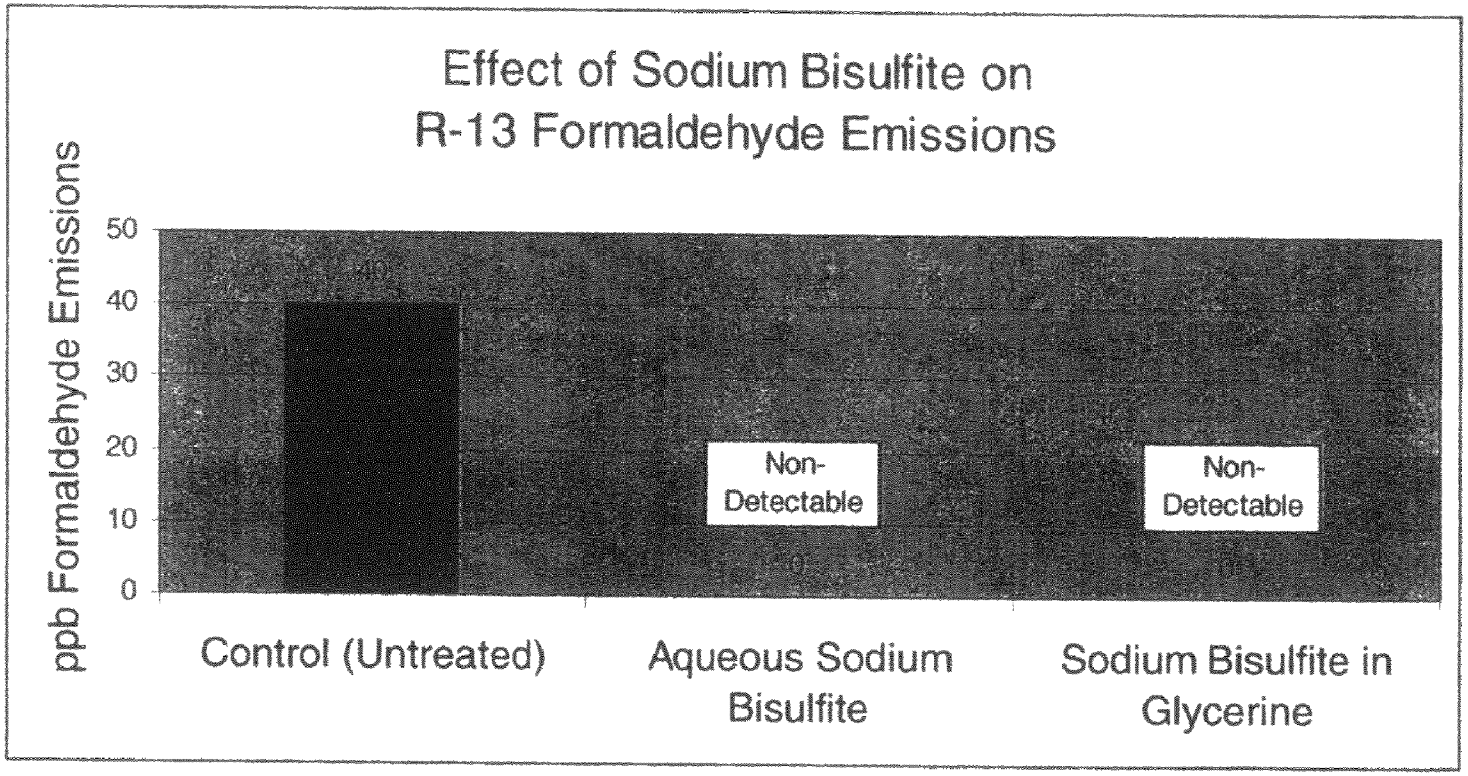

FIGURE 8: BISULFITE OVERSPRAY WITH BISULFITE SHEET: EFFECT OF AMOUNT OF BISULFITE
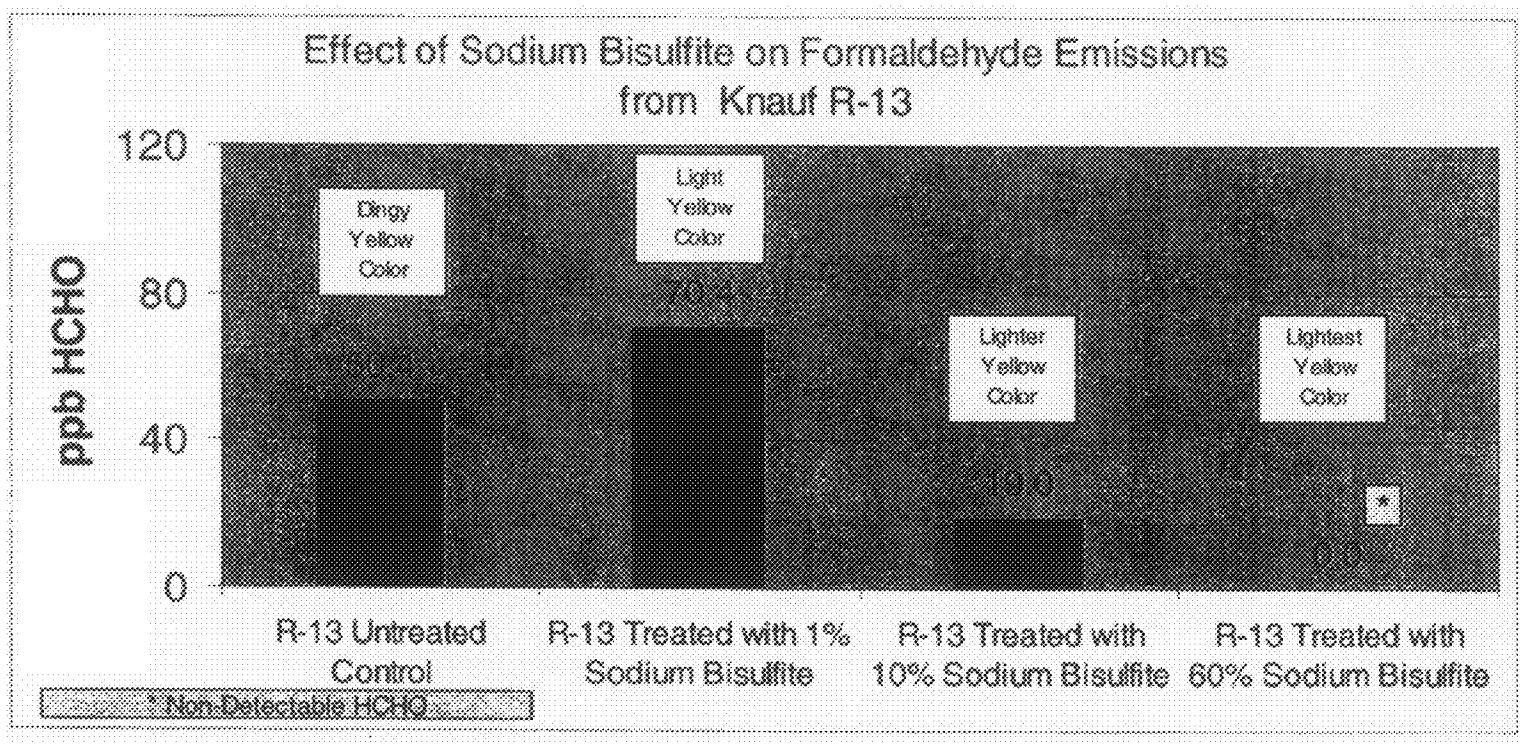

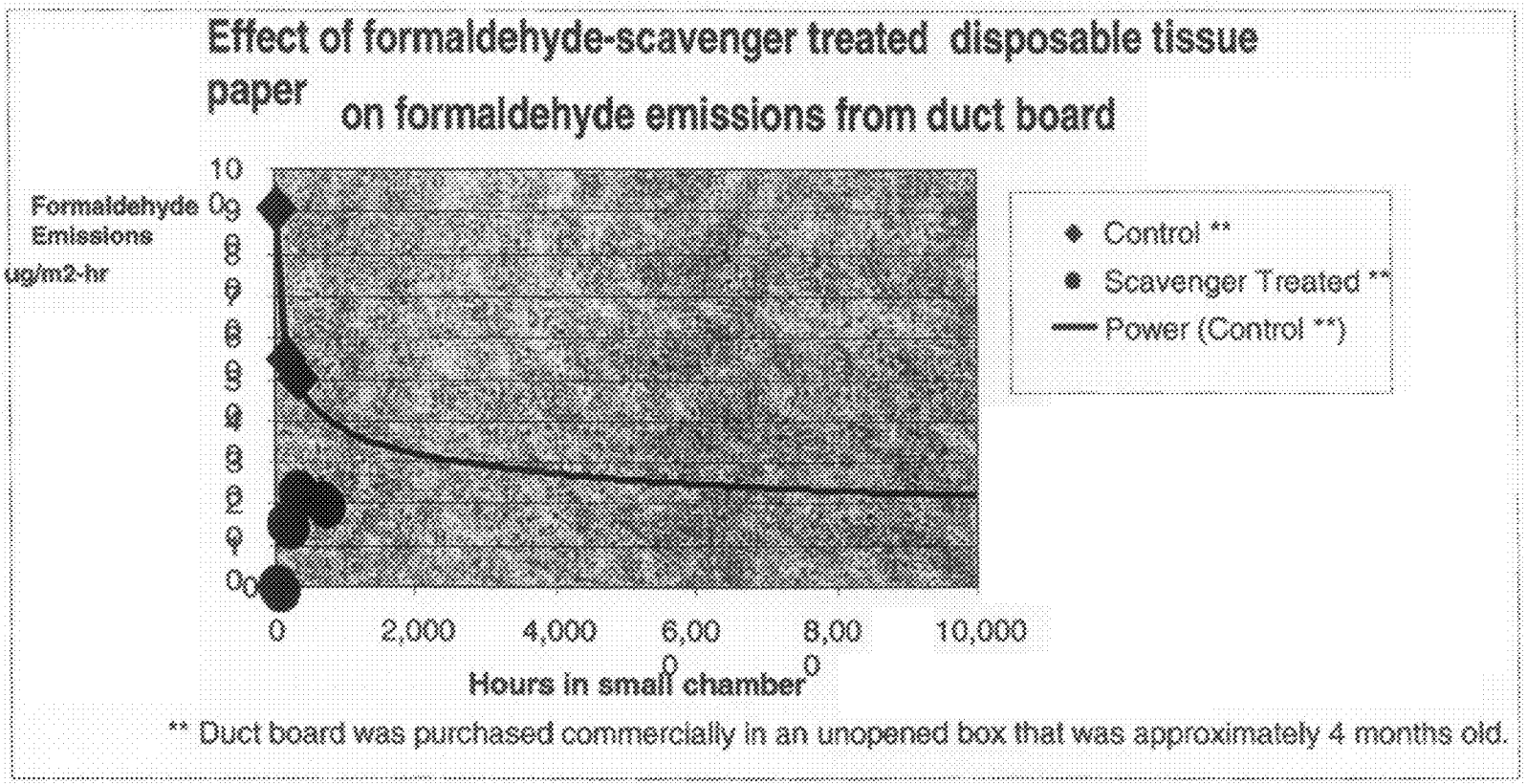
Figure 9: Formaldehyde scavenger sheet material: Effect on product emissions from duct board.

Figure 10: Formaldehyde scavenger sheet material: Effect on product emissions from molded insulation
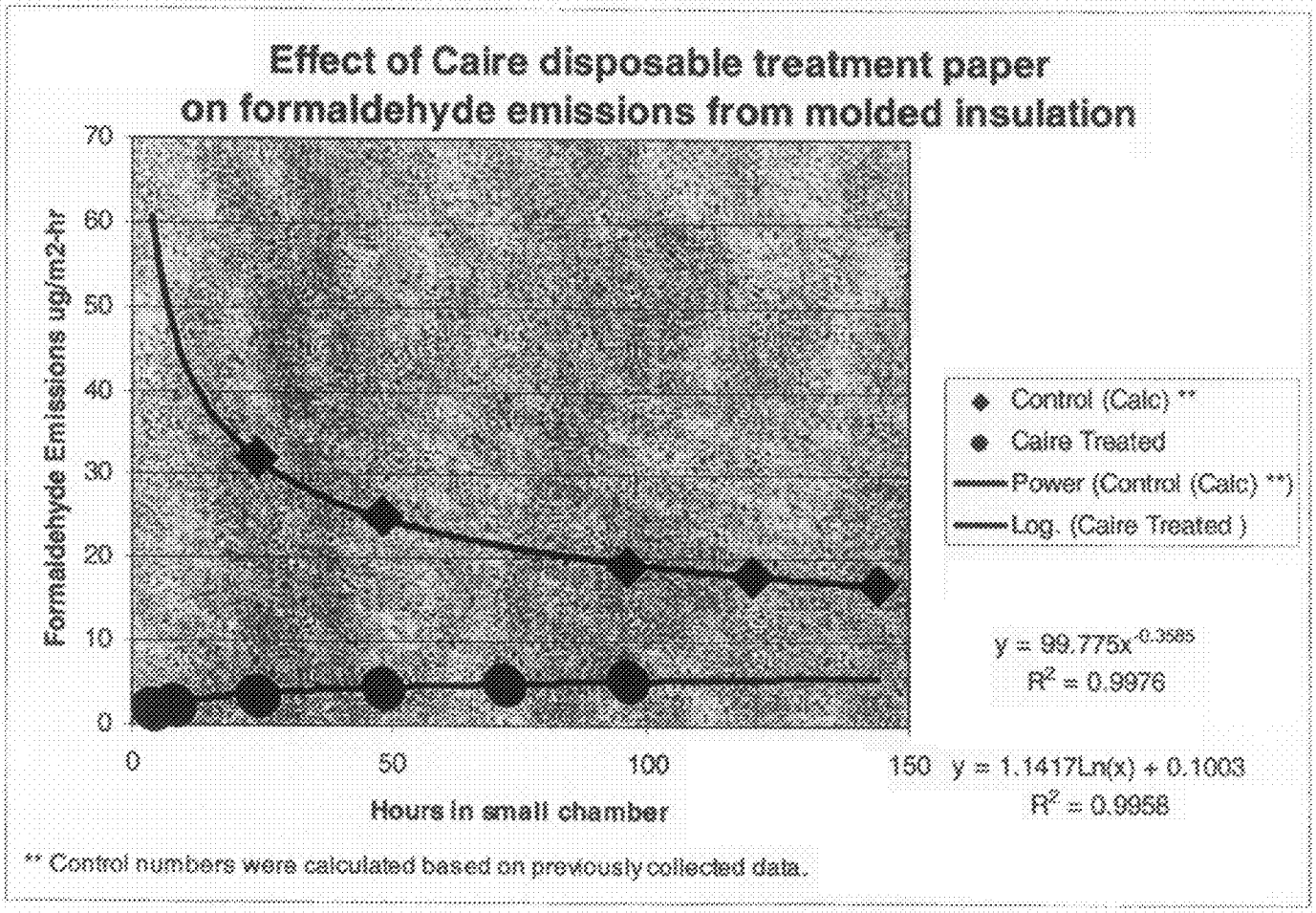

FIGURE 11: BISULFITE OVERSPRAY WITH SOLID BISULFITE VS CONTROL
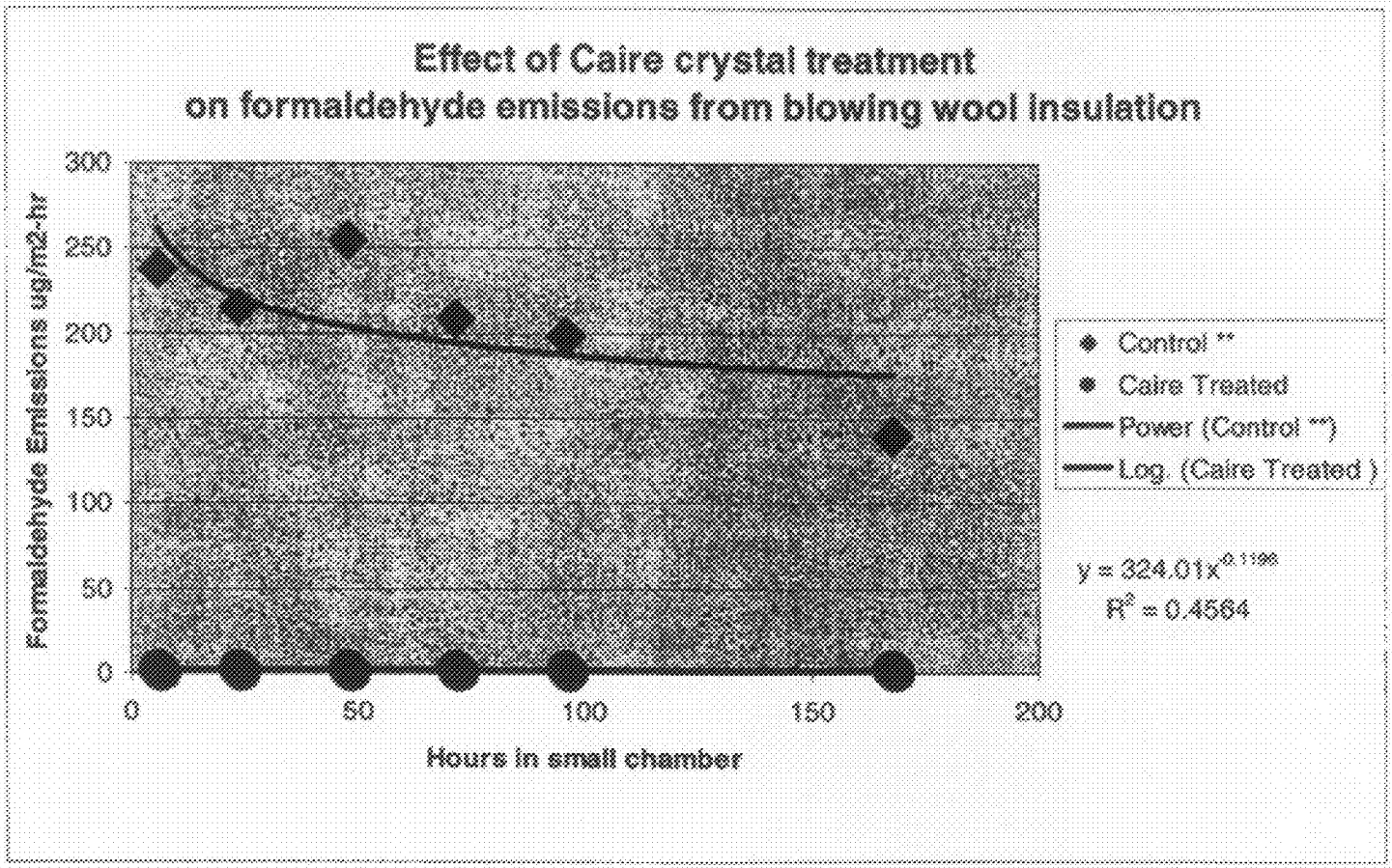

POROUS FIBERGLASS MATERIALS HAVING REDUCED FORMALDEHYDE EMISSIONS

CROSS REFERENCE TO RELATED APPLICATIONS

This application is a continuation-in-part application of U.S. patent application Ser. No. 11/466,535, filed Aug. 23, 2006, now abandoned, which is a continuation-in-part application of U.S. patent application Ser. No. 11/478,980, filed Jun. 30, 2006, now U.S. Pat. No. 7,989,367. This application is also a continuation-in-part of U.S. patent application Ser. No. 11/560,197, filed Nov. 15, 2006, now abandoned, which is a continuation-in-part application of U.S. patent Ser. No. 11/450,488, filed Jun. 9, 2006,now abandoned. This application is also a continuation-in-part of U.S. patent application Ser. No. 11/767,709, filed Jun. 25, 2007, now abandoned, which is a continuation-in-part application of U.S. patent application Ser. No. 11/688,892, filed Mar. 21, 2007, now abandoned. The disclosures of each of the aforementioned applications are incorporated herein in their entireties by this reference.

FIELD OF THE INVENTION

The present invention relates to formaldehyde scavenger treatments for porous fiberglass material having formaldehyde emitting binders thereon. The invention also relates to methods of making porous fiberglass material having reduced formaldehyde emissions.

BACKGROUND OF THE INVENTION

Phenol-formaldehyde (PF) resins, as well as PF resins extended with urea (PFU resins), have been the mainstays of porous fiberglass material technology over the past several years. Such resins are inexpensive and provide the cured fiberglass insulation product with excellent physical properties.

One common type of porous fiberglass material is fiberglass insulation. Generally, fiberglass insulation is shipped in a compressed form to facilitate transportation and reduce costs. When the compressed bundles of fiberglass are used at a job site, it is important that the compressed fiberglass product recover a substantially amount of it pre-compressed thickness. If not, the product will suffer a decrease is its thermal insulation and sound attenuation properties. Fiberglass insulation made with PF and PFU resins is able to recover most of its pre-compressed thickness, thus contributing to the wide acceptance of these resins in this application.

Fiberglass insulation is typically made by spraying a dilute aqueous solution of the PF or PFU resin adhesive binder onto glass fibers, which are generally hot from being recently formed. A mat or blanket of the resin-treated fibers is formed from the hot fibers and the mat or blanket is heated to an elevated temperature in an oven to complete the cure of the adhesive resin binder.

Manufacturing facilities using PF and PFU resins as the main adhesive binder component for porous fiberglass material recently have invested in pollution abatement equipment to minimize the possible exposure of workers to formaldehyde emissions and to meet Maximum Achievable Control Technology (MACT) requirement Standards during the manufacturing of the fiberglass insulation. This technology has successfully reduced exposure to formaldehyde during the manufacturing process.

Reducing formaldehyde emissions in the manufacturing environment, however, does not necessarily reduce formaldehyde emissions from the resulting insulation product. Producing a product having a reduced tendency to emit formaldehyde remains a goal of manufacturers producing products bonded with formaldehyde-containing resins. The fiberglass insulation industry is very concerned with formaldehyde emissions from their finished product due to end user customer concerns about indoor air quality. Fiberglass producers that have continued to use phenol-formaldehyde resins have been moving to obtain certification by a third-party organization called "Green Guard" which tests the emissions of products, which is possible to obtain when the product emits less than 50 ppb formaldehyde. However, the "gold standard" for certification is that the amount of emissions from the product is "below quantifiable limits." In short, it has been an unrealized goal to date to obtain below quantifiable limits of formaldehyde in a porous fiberglass material.

Attempts have been made to scavenge formaldehyde emissions in a building environment, where the formaldehyde emissions emanated from a product having a formaldehyde-emitting binder thereon. As one example, U.S. Pat. No. 4,409,375, the disclosure of which is incorporated herein in its entirety by this reference for the discussion of the aldehyde scavenging aspect therein, discloses the use of an aqueous bisulfite solution to reduce the presence formaldehyde emissions. In the '375 patent, six pans (totaling 2 gallons of a 1% aqueous bisulfite solution were placed in a room. After 4 days, the amount of formaldehyde emissions in the room decreased to a minimum amount. The method disclosed in the '375 patent only dealt with emissions that were released into the room; the substrate remained a formaldehyde emitter even with the bisulfite in the room. The formaldehyde-emitting material in the '375 patent could not have absorbed the bisulfite due to the high density thereof. Thus, the method of the '375 patent would not be effective in stopping formaldehyde emissions.

Another option of reducing formaldehyde emissions in the field of fiberglass insulation has been described in U.S. Pat. No. 5,578,371, the disclosure of which is incorporated herein in its entirety by this reference for the discussion of the formaldehyde reduction therein. However, the emissions reduction taught is directed towards reducing formaldehyde emissions in the manufacturing process, not in the finished product. In the '371 patent, a scavenger, which is a bisulfite material, is mixed with the uncured binder before being sprayed onto the fiberglass, during the manufacture of the fiberglass insulation. In evaluating the method of the '371 patent, the inventors herein have determined that the bisulfite becomes incorporated into the binder during cure, thus reducing the amount of binder available to form cross-links, especially at higher levels of scavenger (e.g., greater than 5% by weight of binder solids). Further, the inventors herein have determined that the method of the '371 patent has minimal, if any, affect on the amount of formaldehyde emitted from the cured binder.

As an alternative to PF and PFU resins, certain formaldehyde free formulations have been developed for use as an adhesive binder for making fiberglass insulation products. Such technology potentially holds the promise of lowered formaldehyde emission from the ultimate product. Unfortunately, however, implementation of the commercial technology that is currently available is considerably more expensive, in terms of both raw material cost and equipment upgrades, relative to the PF and PFU resins that have been the mainstay of the fiberglass insulation industry.

There thus remains an unmet need to have a way to reduce emissions from a formaldehyde-emitting binder that has been cured.

SUMMARY OF THE INVENTION

In a first aspect, the invention relates to a method of reducing formaldehyde emissions in a porous fiberglass material comprising:

a) providing a first porous fiberglass material comprising a formaldehyde-emitting binder; and b) applying at time equal zero minutes a formaldehyde scavenger overspray to the first porous fiberglass material;

wherein:

i) the first porous fiberglass material comprises formaldehyde-emissions in need of scavenging and a density of less than about 350 Kg/m3; and ii) the binder is substantially cured prior to the contacting step.

In a second aspect, the invention relates to a method of scavenging formaldehyde emissions from a porous fiberglass material in need of scavenging of formaldehyde emissions comprising;

b) providing a first porous fiberglass material comprising formaldehyde emissions in need of scavenging;

c) introducing a sheet material having formaldehyde scavenger applied thereto to the environment of the first porous fiberglass material; and d) maintaining the sheet material in the environment of the first porous fiberglass material for a time suitable to reduce formaldehyde emissions in the first porous fiberglass material.

Other aspects of the invention will be appreciated from the following detailed description.

BRIEF DESCRIPTION OF THE DRAWINGS

FIG. 6 examines handsheet strength as a function of formaldehyde scavenger addition point.

FIG. 7 examines the effect of bisulfite treatment on R-13 emissions

FIG. 8 examines effect of the amount of bisulfite with bisulfite sheet on product formaldehyde emissions.

FIG. 9 shows the effect of formaldehyde scavenger sheet material on product emissions from molded insulation.

FIG. 10 shows the effect of formaldehyde scavenger sheet material on product emissions from molded insulation FIG. 11 examines the effect of bisulfite overspray with solid bisulfite on product formaldehyde emissions.

DETAILED DESCRIPTION OF THE INVENTION

Figure 1:
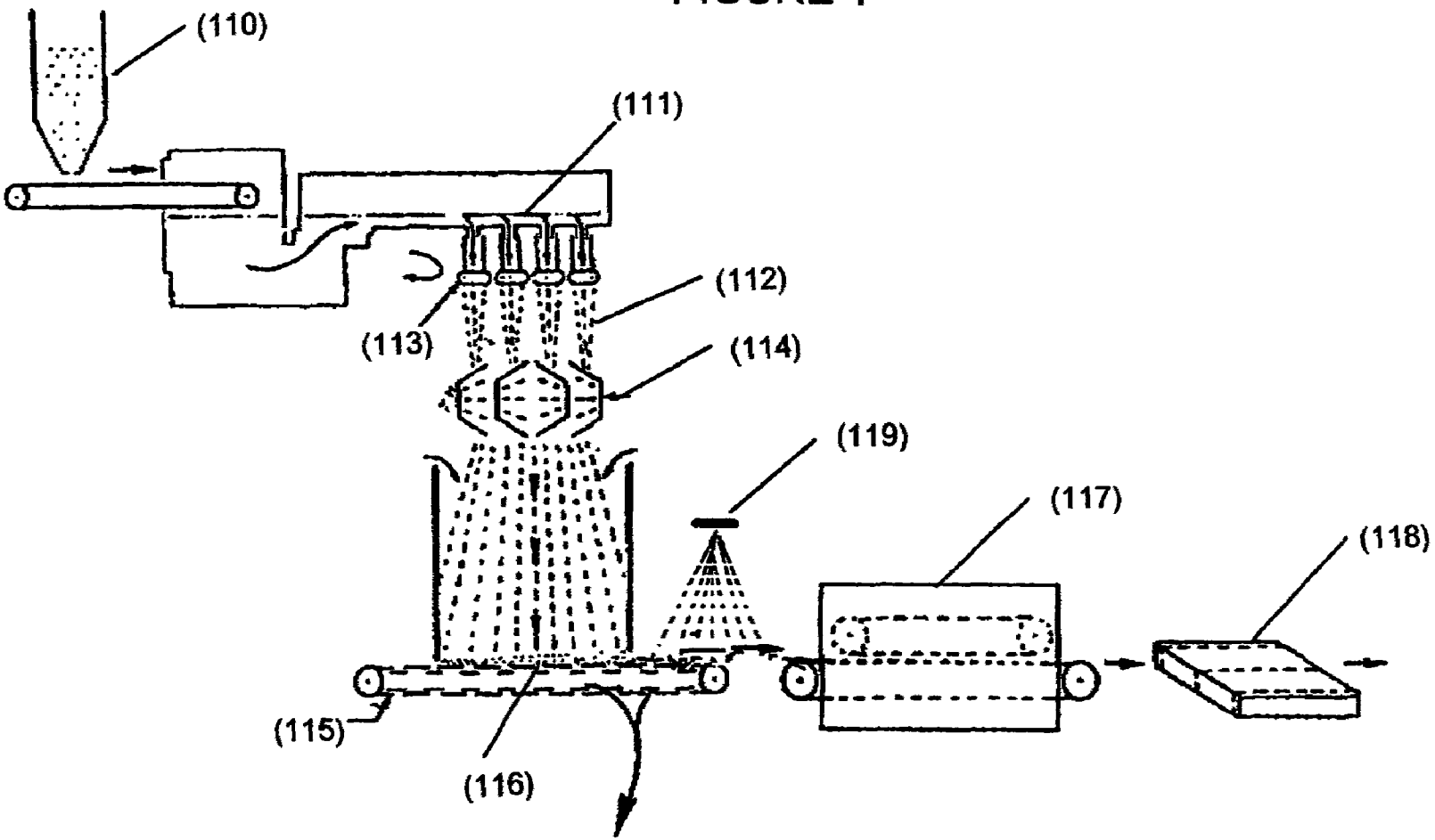
FIG. 1 illustrates one embodiment of a method of making fiberglass insulation having a reduced tendency to emit formaldehyde.

The present invention relates to porous fiberglass material having a formaldehyde-emitting binder thereon that has been treated with a formaldehyde scavenger after the binder has been substantially cured. After substantial curing of the resin, the porous fiberglass material is treated with a formaldehyde scavenger according to methods described hereinafter. The after-treatment of the porous fiberglass material with the formaldehyde scavenger has surprisingly been found to provide a porous fiberglass material having markedly lower formaldehyde emissions than porous fiberglass materials not treated with the scavenger. Further, the tensile properties of porous fiberglass materials treated with the scavenger after curing of the resin have been found to be excellent.

As used herein, the phrase "formaldehyde-emitting binder" means a resinous, thermosetting composition made from a molar excess of formaldehyde and one or more formaldehyde-reactive monomers such as phenol, urea, acetone, melamine and the like. Such binders typically contain free, i.e., unreacted formaldehyde, and exhibit formaldehyde emissions during their cure and in the absence of an effective treatment, following their cure. Such binders are commercially available from resin suppliers such as Georgia-Pacific Chemicals, LLC. More discussion of the formaldehyde-emitting binders are discussed herein. However, in brief, a formaldehyde-emitting binder commonly used in connection with the manufacture of fiberglass insulation is one made by reacting a molar excess of formaldehyde with phenol in the presence of an alkaline catalyst such as sodium hydroxide. Before this binder is used, it is commonly premixed with urea and the urea is allowed to react with residual formaldehyde, such as for 4-16 hours, before the binder is prepared for making the fiberglass insulation.

As used herein, "curing,""cured" and similar terms are intended to mean the structural and/or morphological change which occurs to an aqueous binder of a formaldehyde-containing resin, such as, for example, by covalent chemical reaction (crosslinking), ionic interaction or clustering, improved adhesion to the substrate, phase transformation or inversion, and hydrogen bonding when the resin is dried and heated to cause the properties of a porous fiberglass material, such as a mat or blanket of glass fibers to which an effective amount of the formaldehyde-emitting binder has been applied, to be altered. Herein, the porous fiberglass materials are "substantially cured" when structural and/or morphological change of the resin is substantially complete as a result of heating of the resin or application of other operations. Put another way, when the resin is substantially cured, it will be substantially non-reactive such that the formaldehyde scavenger will be able to react or interact only with any formaldehyde in the environment. There will be no or essentially no reaction between the binder and formaldehyde in the environment when the binder is substantially cured.

"Substantially reduced" or "substantial reduction" when used in relation to formaldehyde emissions from a porous fiberglass material means that the amount of formaldehyde emitted from formaldehyde scavenger-treated first porous fiberglass material having a formaldehyde-emitting binder cured thereon are at least about 75% lower than the formaldehyde emissions from a second porous fiberglass material having the same formaldehyde binder substantially cured thereon, where the first and second porous fiberglass materials have been aged for the same time and at the same environmental conditions. "Essentially free of formaldehyde emissions" means that the first porous fiberglass material exhibits at least about 95% lower formaldehyde emissions than the second porous fiberglass material, where the second porous fiberglass material has been comparably treated with binder and aged under the same conditions.

"Below quantifiable limits" ("BQL") means a below quantifiable level of 0.1 μg for formaldehyde based on a standard 45 L air collection value, when the test sample is obtained from an environmental chamber in a test in accordance with ASTM D 5116, and where the analysis is based on EPA Method IP-6A and ASTM for formaldehyde by HPLC. These ASTM and EPA methodologies are incorporated herein in their entireties by this reference.

"Overspray" as used herein includes using an aqueous solution comprising the formaldehyde scavenger incorporated therein, for treating onto a porous fiberglass material wherein the aqueous solution is suitable for spraying onto a fiberglass material. An "overspray" can also include an aqueous solution that consists essentially of a formaldehyde scavenger incorporated therein, wherein the aqueous solution is suitable for spraying onto a porous fiberglass material. "Overspray" can also include the application of a neat formaldehyde scavenger to a porous fiberglass material. The neat formaldehyde scavenger can be solid, liquid or gaseous. The overspray aspect of the present invention is discussed in more detail herein.

As used herein, "aqueous solution" means a solution composed substantially of water. As used herein, the phrase "consisting essentially of" used in connection with the aqueous solution of the formaldehyde scavenger is intended to exclude from the aqueous mixture any ingredients that would change the basic formaldehyde-scavenging purpose and function of the formaldehyde scavenger that is applied with the aqueous solution. Thus, this phrase is intended to exclude any ingredient, such as any formaldehyde-containing resin binder, from the aqueous formaldehyde scavenger mixture that would increase the amount of formaldehyde present in the system after substantial curing of the formaldehyde-emitting binder in the porous fiberglass material.

The formaldehyde scavenger aqueous composition can optionally include a pH adjusting agent if such is necessary to obtain the desired pH. The pH can be from about 3 to about 6 when bisulfite is preferred because this pH range will maximize the amount of bisulfite species available for scavenging. However, in general, a wide range of pH's (i.e., from 3-14) can be used. Typical pH adjusting agents can be used, except that it may not be desirable to use strong acids to adjust the pH of the bisulfite solution due to the possibility of unintentional release of sulfur dioxide.

As used herein the terms "fiber," "fibrous" and the like means materials that have an aspect ratio (length to thickness) of greater than about 100, generally greater than about 500, and often greater than about 1000. Porous fiberglass material in accordance with the invention herein are typically formed from glass fibers having the above-stated dimensions.

Fibers suitable for use in porous fiberglass material can be prepared in the form of mats or blankets fabricated by swirling the endless filaments or strands of continuous fibers, or they may be chopped or cut to shorter lengths for mat, batt or blanket formation. Ultra-fine fibers formed by the attenuation of glass rods can also be used. Also, such fibers may be treated with a size, anchoring agent or other modifying agent before use in making the porous fiberglass material. A mat or blanket is made from such fibers also can be ground or cubed into smaller pieces to form known as "blowing wool" material after curing of the binder, such as the Advanced ThermaCube Plus® product commercially available from Owens-Corning. Another type of blowing wool is SuperCube®, which is available from Guardian. With such blowing wool material, the formaldehyde scavenger can be added before or after comminuting into smaller pieces.

Porous fiberglass materials used in accordance with the present invention can also contain fibers that are not in themselves heat-resistant such as, for example, certain polyester fibers, rayon fibers, nylon fibers, cellulose fibers and super absorbent fibers, as long as they do not materially adversely affect the performance of the fibrous product.

As used throughout the specification and claims, the term "porous fiberglass material" means a substantially permeable material made of glass fibers. "Substantially permeable" means that the fiberglass material is of a low enough density after curing of a formaldehyde binder thereon that a formaldehyde scavenger-containing overspray is able to permeate the porous fiberglass material so as to effectively scavenge predominately all of any residual formaldehyde present after the binder has been cured in the porous fiberglass material. Low density porous fiberglass materials are also significant in that formaldehyde emissions are readily able to diffuse from the interior of the porous fiberglass material to further improve the efficacy of the formaldehyde scavenger of the present invention. Such a feature is not present with high density materials such as particleboard or plywood.

Densities of fibrous porous fiberglass materials that can be treated with formaldehyde scavenger according to the present invention can range from about 5 $Kg/m^3$ to about 350 $Kg/m^3$. Still further, the densities of materials treated with the formaldehyde scavenger of the present invention can range from about 5, 20, 40, 50, 75, 100, 125, 150, 175, 200, 225, 250, 275, 300, 325 or 350 $Kg/m^3$, where any value can form an upper or a lower endpoint, as appropriate. To illustrate materials falling inside and outside this range, the following Table is helpful:

| Product Description | Density $Kg/m^3$ |
|---|---|
| Blowing Wool insulation (compressed in bag) | 135 |
| R-13 batt insulation (compressed in bag) | 67 |
| R-13 batt insulation (as made - uncompressed) | 9 |
| Duct board insulation (as made) | 52 |
| Glass mat (as made) | 99 |
| Particleboard (as made) | 721 |

It has been found by the inventors herein that the formaldehyde scavenger treatments of the present invention will be effective when the formaldehyde scavenger can freely permeate the fibrous porous fiberglass material so as to be able to diffuse within the porous glass material and come into contact with free formaldehyde present in and around the material. Because this diffusion and permeation forms a significant basis of the present invention, the present invention does not include formaldehyde scavenger of formaldehyde-containing materials that are not porous and low density. That is, this invention does not include materials having a density of greater than about 350 K/m3.

In one form, the porous fiberglass material can comprise fiberglass insulation. This group of materials includes, but is not limited to, batt products, roll products, blowing wool, board products (i.e., duct board), mineral wool, flexible duct media, molded products (e.g., automotive interiors or hood liners), pipe insulation and sound deadening media, e.g., for home theaters systems.

In some forms, such as when the porous fiberglass material comprises rolled or batted fiberglass insulation, the porous fiberglass material can be lined on one or both outer surfaces. The liner can be paper (typically Kraft paper), plastic (to form a vapor barrier), foil (to form a heat barrier), or a laminate thereof and prepared in rolled form. Alternatively to rolling, the lined porous fiberglass material, batt or blanket can be cut into lengths (for example, 8 foot lengths) and packaged for use as insulation. Rolled and unrolled porous fiberglass materials, batts or blankets are available from, for example, Owens-Corning (Toledo, Ohio). Unlined fiberglass mats, batts, or blankets can be cubed or ground to produce related blowing "wool" insulation products (such as Advanced ThermaCube Plus or SuperCube brands blowing wool (i.e., loose fill fiberglass).

In another form, the porous fiberglass material can comprise glass mat products. Glass mat products are glass fibers bound with formaldehyde-emitting binder. Glass mat products are commonly used as substrates for roofing, as in backing for drywall products. One example of a drywall product that can utilize a glass mat as a facing material is DensGlas Gold® (Georgia-Pacific Building Products, LLC, Atlanta, Ga.).

Other porous fiberglass materials that commonly comprise formaldehyde-emitting binders include: air filters, roving, microglass-based substrate for printed circuit boards or battery separators, filter stock, tape stock and reinforcement scrim in cementitious and non-cementitious coatings for masonry. Since formaldehyde emissions can also be a concern with these products, the present invention is suited for applications therewith.

Bisulfite materials have been found to be particularly suitable for use as formaldehyde scavenger in accordance with the present invention. Sulfites are also believed to be suitable for use as formaldehyde scavenger in accordance with the present invention. Examples of suitable bisulfite and sulfite materials include: sodium bisulfite, sodium metabisulfite, ammonium sulfite, ammonium bisulfite, sodium hydrogen sulfite, sodium sulfite, other alkali metal and alkaline earth metal bisulfites and amine bisulfites and sulfites. Sodium bisulfite has been found to be a particularly suitable bisulfite material for use in the invention herein. Additional sulfur-containing materials that are believed to be suitable for use in the present invention are sulfur compounds with a valence state other than +6 such as sulfur dioxide. Sulfur dioxide has been found to be an effective formaldehyde scavenger when used in accordance with the invention herein.

Other types of formaldehyde scavengers can also be suitable for use in the present invention. Such formaldehyde scavenger materials include, but are not limited to, urea ((H2N)2C═O), low ratio melamine resins, i.e., melamine-formaldehyde resins made with a molar excess of melamine, resorcinol, polyacrylamide, acrylamide, methacrylamide, melamine, biuret (HN[(H2N)C═O]2), triuret (N[(H2N)C═O]3), biurea ([HN(H2N)C═O]2), polyurea, acid salts of aniline, aromatic amines, aliphatic amines, diethylene triamine, triethylene tetraamine, tetraethylene pentamine, other polyamines and their salts, ammonia, polyamidoamines, amino acids, aromatic amino acids such as glycine, p-amino benzoic acid, ammonium bicarbonate, ammonium carbonate, polyethyleneamines, sodium sulfamate, ammonium sulfamate, methane sulfonamide, succinimide, dicyandiamide (NCNH(H2N)C═NH), proteins (for example: soy, animal and plant proteins), an aminopolysaccharide, such as chitosan, thiourea ((H2N)2C═S), guanadine ((H2N)2C═NH), sodium salts of taurine, sulfanilic acid, disodium salt of glutamic acid, zeolites, permanganate and similar materials.

In one aspect, the present invention comprises a method of treatment of a first porous fiberglass material, wherein the fiberglass material comprises a substantially cured formaldehyde-emitting binder, and wherein the fiberglass material has been treated (considered to be time equal to zero minutes) with a formaldehyde scavenger overspray, thereby providing a first porous fiberglass material with reduced tendency to emit formaldehyde, as compared to a second porous fiberglass material that has been comparably treated with a formaldehyde-emitting binder but has not been treated with the formaldehyde scavenger overspray, where the formaldehyde emissions in the first and second materials are measured when the materials have been aged for equal periods. "Aged" means that the amount of time from completion of the manufacturing process is the same and that the conditions under which the first and second materials were stored are identical. The amount of formaldehyde emissions will vary according to the treatments, as discussed in more detail herein. In particular, the method further comprises at about 100 hours of aging, i.e., at about 100 hours after time equal zero minutes, comparing the formaldehyde emissions of the first porous fiberglass material to the formaldehyde emissions of the second porous fiberglass material, wherein the second porous fiberglass material comprises the same substantially cured binder and has approximately the same density as the first porous fiberglass material, wherein at a time immediately prior to time equal zero, the second porous fiberglass material comprises approximately the same amount of formaldehyde emissions in need of scavenging as the first porous fiberglass material, and wherein the first and second porous fiberglass materials are aged under the same conditions from time equal zero to the time when the emissions of the first and second porous fiberglass materials are compared.

In a further aspect, the overspray treatment can comprise a formaldehyde scavenger in the presence of water to provide an aqueous solution comprising a formaldehyde scavenger. Still further, the aqueous solution can consist essentially of a formaldehyde scavenger and water. While not preferred presently, glycerin and other types of inert diluents other than water could be suitable in the present invention.

The amount of formaldehyde scavenger used in a particular instance will depend largely on the affinity of the particular scavenger for formaldehyde emitted from the formaldehyde-emitting binder. The amount of formaldehyde scavenger is expressed as a weight percent of formaldehyde scavenger, such as a weight of sodium bisulfite, per weight of binder solids. Binder solids are considered to be the equivalent to the loss on ignition ("LOI") value, which is the measure of organic material lost upon high temperature treatment of the porous fiberglass material having binder thereon. In all instances herein, the amount of formaldehyde scavenger is expressed as a weight percent of formaldehyde scavenger per weight of binder solids (or LOI).

When the formaldehyde scavenger is applied to the porous fiberglass material in the form of a solid, the % formaldehyde scavenger is the weight percent of formaldehyde scavenger per weight of binder solids (or LOI). If an aqueous solution or a formaldehyde scavenger-treated sheet material is used, the amount of formaldehyde scavenger applied is calculated by determining the weight % of formaldehyde scavenger material in the solution or on the paper per LOI of the porous fiberglass material.

When a solid formaldehyde scavenger forms the basis of the treatment (whether applied in neat form or from an aqueous solution) the amount of formaldehyde scavenger used can vary within a broad range. Where the overspray comprises a solid, the overspray can be applied at from about 1 to about 75 weight percent, as measured by weight of the binder solids in the porous fiberglass material. In other embodiments, for example, where the solid formaldehyde scavenger forms the basis of the treatment (whether applied in neat form or from an aqueous solution) the amount of formaldehyde scavenger used can vary from 0.1 to about 50 weight percent formaldehyde scavenger per weight binder solids (or LOI). Still further, the formaldehyde scavenger can comprise from about 5 weight percent to about 40 weight percent formaldehyde scavenger per weight binder solids (or LOI). Yet further , the formaldehyde scavenger can comprise from about 10 weight percent to about 40 weight percent formaldehyde scavenger per weight binder solids (or LOI). Still further, the amount of formaldehyde scavenger used can be from about 1, 5, 10, 15, 20, 25, 30, 35, 40, 45 or 50 weight percent formaldehyde scavenger per weight binder solids (or LOI), where any of the stated values can form an upper or lower endpoint, as appropriate.

When the overspray is added to the porous fiberglass materials having substantially cured formaldehyde-emitting binder thereon in the form of an aqueous solution, the material can conveniently be dried after application as a result of the residual heat on the porous fiberglass material after substantial curing of the binder. Also, application of the aqueous solution in the form of an atomized spray can also assist in effecting drying of the aqueous solution.

The overspray treatment of the formaldehyde scavenger can also be applied in a pure or neat form, as a solid, as a liquid, or as a gas. Put another way, the formaldehyde scavenger can be applied to the porous fiberglass material without a diluent. Again, the important feature of the invention is that the scavenger is applied to the porous fiberglass material after the substantial curing of the binder so that the scavenger does not have a significant opportunity to interfere with the non-reacted resin.

When applied as a neat material, the neat formaldehyde scavenger can also consist essentially of the formaldehyde scavenger. In this context, "consists essentially of" means that the formaldehyde scavenger is present in an amount suitable to provide efficacious formaldehyde scavenging. Thus, the presence of a filler or other non-formaldehyde-scavenging material with the formaldehyde scavenger is within the scope of the invention herein, as long as such materials do not effect the efficacy of the formaldehyde scavenger in scavenging formaldehyde emissions.

Depending on the nature of the non-diluent-containing formaldehyde scavenger itself (i.e., the neat form), distribution of the material into the porous fiberglass material could be done by sprinkling a solid onto the mat (possibly with a shaking of the mat to assist passage of the scavenger into the material). When the formaldehyde scavenger is a solid in neat form, the solid can be, for example, a powder or a prill.

The inventors herein have also determined that sulfur-containing gas is also suitable for use as a formaldehyde scavenger in accordance with the present invention. In one aspect, a sulfur-containing gas, in particular sulfur dioxide, can be applied to the porous fiberglass material having a formaldehyde-emitting binder substantially cured thereon. In one form, the gas can be introduced to a closed environment, such as in a sealed room or in a box to reduce the possibility the gas will diffuse into the environment and to possibly increase the efficacy of the gaseous overspray treatment.

When the formaldehyde scavenger treatment is a sulfur dioxide (e.g. a gas), the amount of gaseous formaldehyde scavenger treatment can be from about 0.01 weight % to about 10 weight % sulfur dioxide, or from about 0.01% to about 5 weight % sulfur dioxide, or from about 0.01 weight % to about 2 weight % sulfur dioxide, or from about 0.01 weight % to about 1 weight % sulfur dioxide, as measured by weight binder solids (or LOI). Yet further the amount of gaseous formaldehyde scavenger can be from about 0.01, 0.1, 0.25, 0.50, 1.0, 2.0, 3.0, 4.0, 5.0, 7.0 or 10.0 weight % sulfur dioxide by weight binder solids (or LOI), where any value can form an upper or lower endpoint, as appropriate.

While the sulfur-containing gas has been seen to be very effective in scavenging formaldehyde in a closed environment, in a surprising discovery, it has been found by the inventors herein that sulfur-containing gas is highly effective as a formaldehyde scavenger even when the environment was not completely closed. For example, the sulfur-containing gas, in particular sulfur dioxide, can be injected into a conventional commercial package of insulation. Significantly, such insulation packages typically include several holes to allow air to escape when the insulation is inserted into the bag during packaging for shipping and storage. For example, a bag or box of insulation typically includes about 4 to about 16 1" holes per 0.25 $m^3$ bag. After the insulation is introduced into the plastic bag through the large opening of the bag, the opening is generally sealed either by heat or by taping the bag closed. When the inventors injected sulfur-containing gas into the insulation package, they were surprised to discover that the sulfur-containing gas did not escape from the package but, rather, stayed essentially contained within the package. This resulted in the sulfur-containing gas staying in the vicinity of the insulation to retain effectiveness as a formaldehyde scavenger as opposed to permeating into the environment. Also, this containment reduced the propensity of the sulfur-containing gas to diffuse into the environment and, thus, acting as an industrial contaminate by being released into the manufacturing environment. The inventors herein further discovered that the sulfur-containing gas was effectively consumed after a short time as a result of the combination of the sulfur-containing gas with the formaldehyde in the vicinity of the insulation resulting in a relatively harmless salt material.

With respect to this salt product, which is known as formaldehyde sodium bisulfite adduct, this material is stable, breaking down at temperatures greater than 150° C. Such a temperature will not be seen in use.

The inventors were surprised to discover that sulfur dioxide could be suitably used in the present invention. There are limitations worker exposure to sulfur dioxide. Sulfur dioxide would not generally be suitable for use in a consumer product. However, the inventors herein have discovered that a small amount of sulfur dioxide could be effective in scavenging formaldehyde from porous fiberglass material without permeation into the environment. It is believed that the sulfur dioxide is consumed relatively quickly whereby the sulfur dioxide combines with emitted formaldehyde to form a harmless salt product.

The inventors herein have determined that the different overspray treatments can provide differing formaldehyde emissions conditions. However, in all instances, the application of the formaldehyde scavenger directly to the porous fiberglass material has been shown to provide significant reduction in formaldehyde emissions from a material comprising a substantially-cured formaldehyde-emitting binder.

For example, when the overspray is the neat formaldehyde scavenger treatment, the formaldehyde emissions level is below quantifiable limits as measured by ASTM 5116 after about 16 hours of treatment. Still further, when the overspray is the neat formaldehyde scavenger treatment, the formaldehyde emissions level is below quantifiable limits as measured by ASTM 5116 after about 8 hours of treatment. Yet further, when the overspray treatment is the neat solid formaldehyde scavenger treatment, the formaldehyde emissions level as measured by ASTM 5116 is below quantifiable limits after about 1 hour of treatment.

In a further example, when the overspray is the gaseous formaldehyde scavenger treatment, the formaldehyde emissions level is non-detectable after about 100 hours as measured by ASTM 5116. In a further example, when the overspray is the gaseous formaldehyde scavenger treatment, the formaldehyde emissions level is non-detectable after about 48 hours as measured by ASTM 5116. In a further example, when the overspray is the gaseous formaldehyde scavenger treatment, the formaldehyde emissions level is non-detectable after about 24 hours as measured by ASTM 5116.

The inventors have observed that when using sulfur dioxide of the present invention with as little as 0.12 g sulfur dioxide per Kg of insulation has reduced the equilibrium level of formaldehyde emission from a blowing wool fiberglass product (as measured using the Dynamic Micro Chamber procedure—see the following Examples) from 338 ppb to a non-detectable level. While one has a wide latitude in establishing an upper limit on the amount of the gaseous scavenger to use in the broad practice of this embodiment of the present invention, based on considerations of safety and cost, the inventors contemplate using anywhere from about 0.03 g to about 10.0 g of a gaseous formaldehyde scavenger, and preferably gaseous sulfur dioxide, per Kg of insulation. More preferably, applicant contemplates using from 0.06 g to 5.0 g of a gaseous formaldehyde scavenger, and preferably sulfur dioxide, per Kg of insulation. Usually, applicant expects to use from 0.08 g to 0.5 g of a gaseous formaldehyde scavenger, and preferably sulfur dioxide, per Kg of insulation. As noted above, it is convenient to introduce the formaldehyde scavenger into the enclosed space holding the fibrous product using a carrier or dilution gas. This technique provides several advantages. It facilitates delivery of a desired amount of the scavenger gas into the enclosed space and accordingly minimizes waste of the scavenger gas. It also reduces the potential safety hazard associated with any unintentional exhaust of the scavenger gas from the enclosed space.

Sulfur dioxide is particularly suitable as the gaseous formaldehyde scavenger overspray treatment. Based on testing conducted in connection with the scavenging of formaldehyde from fiberglass insulation using the method of the present invention, the inventors herein have observed that sulfur dioxide is more effective than ammonia for reducing the level of formaldehyde emissions from a fiberglass insulation product. In addition, the reaction product that is formed by reaction between sulfur dioxide and formaldehyde is more stable and less odiferous than the corresponding ammonia-formaldehyde product. Indeed, given the present discovery of the effectiveness of sulfur dioxide in reducing formaldehyde emission from packaged insulation products and based on testing conducted in connection with the scavenging of formaldehyde from a packaged commercially available fiberglass insulation product using the method of the present invention, the inventors have shown that sulfur dioxide injection for scavenging formaldehyde emissions can be integrated easily as part of the commercial packaging (bagging or boxing) operation for distributing fiberglass for commercial and residential installation. As a result, the present invention provides an essentially transparent solution to reducing formaldehyde emission from porous fiberglass material.

While the amount of formaldehyde scavenger that results in reduced formaldehyde emissions can be widely varied to obtain satisfactory results, it should be noted that fiberglass insulation must meet fairly stringent specifications in regards to corrosive aspects (among other things) as set out in ASTM C 665-91 and C 795, which disclosure is incorporated in its entirety by this reference. Other porous fiberglass materials are believed to also require non-corrosive properties. Accordingly, when corrosion in use of a porous fiberglass material may be a concern, care should be taken to moderate the amount of formaldehyde scavenger so that excess scavenger, such as bisulfite material and the like, will not cause corrosion when the material is used in a home or building or in another location. The optimum amount of formaldehyde scavenger will vary with the type of porous fiberglass material and the amount and type of formaldehyde-emitting binder, among other things. The particular amount of formaldehyde scavenger to be used in a particular situation can be determined by one of ordinary skill in the art with reference to the variables that will affect the efficacy of formaldehyde scavenger under various conditions.

Treatment time is also believed to vary with the type of porous fiberglass material and amount and type of formaldehyde-emitting binder, among other things. In some aspects, the treatment time can be from about 1 to about 800 hours, or from about 4 to about 400 hours, or from about 8 to about 400 hours, or from about 16 to about 200 hours. The formaldehyde scavenger is typically left in contact with the porous fiberglass material until use, so the stated treatment times refer to the amount of time the formaldehyde scavenger treatment is conducted prior to introduction of the material into an environment where formaldehyde emissions would be a concern (such as a house or building).

The formaldehyde scavenger overspray can be applied to the porous fiberglass material after curing of the binder thereon in the cooling section of the manufacturing process as the product comes out of the oven or as it travels in and through the cooling section of the manufacturing process. It is believed that addition at this location could improve the distribution of the formaldehyde scavenger throughout the porous fiberglass material, which could, in turn, improve the efficiency of the formaldehyde scavenger to scavenge formaldehyde on an initial basis. Also, it is possible application of the formaldehyde scavenger during the cooling process could help reduce the possibility of formaldehyde scavenger from becoming concentrated at a surface of the porous fiberglass material, which, in turn, could reduce the possibility of the formaldehyde scavenger from having corrosive surface properties. However, it is contemplated that the formaldehyde scavenger can be added to the porous fiberglass material at any time at any time after the formaldehyde-emitting binder is substantially cured on the porous fiberglass material, as long as formaldehyde emissions remain in the porous fiberglass material to be scavenged.

A key advantage of the present invention is that because the application of the formaldehyde scavenger is independent of and not intimately commingled with the formaldehyde-emitting resin binder prior to curing, the addition of higher levels of the scavenger does not significantly degrade the tensile properties of the cured binder essential for obtaining a porous fiberglass material with acceptable physical properties. As shown in the following Examples, including the scavenger directly in the binder formulation (internal scavenger), not only fails to adequately reduce formaldehyde emissions in the binder, but also reduces the tensile properties of the cured product.

Thus, the present invention is in contrast to the process disclosed in the '375 patent, which addresses the scavenging of formaldehyde from a solid material (that is, non-porous) over an extended period of time. In the '375 patent, the formaldehyde to be scavenged was made available only by diffusion of formaldehyde in a test room comprising particleboard. The formaldehyde scavenger, an aqueous bisulfite salt solution in the '375 patent, was stationary in a pan and, thus, did not diffuse into the particleboard. Further, as noted above, the particleboard used in the method of the '375 patent had a density in the range of 721 K/m$^3$ and, as such, was not a porous material into which the formaldehyde scavenger could penetrate. In the present invention, the formaldehyde scavenger can intermingle with the formaldehyde emissions within the structure of the product itself, thus allowing the formaldehyde emissions to be scavenged before the formaldehyde emissions enter the environment.

The present invention also differs markedly from that disclosed in the '371 patent. Because the formaldehyde scavenger is applied to the porous fiberglass material after the binder is substantially cured, the scavenger is necessarily added in a separate application (and from a separate pot) from which the binder is applied to the fibers that will form the mat. Thus, unlike the method of applying a formaldehyde scavenger to the porous fiberglass material manufacturing process disclosed in the '371 patent, the formaldehyde scavenger in the present invention does not react with the binder. Rather, by adding the formaldehyde scavenger to the substantially cured formaldehyde-emitting binder, the scavenger will react only with any free formaldehyde that is located in the general vicinity of the porous fiberglass material having the substantially cured resin thereon.

The inventors also believe that addition of the formaldehyde scavenger to the uncured resin as in the '371 patent leaves no scavenger for formaldehyde scavenging after the resin is substantially cured. In short, it is believed that the formaldehyde scavenger is used up in the front end of the process and is not available for scavenging of residual formaldehyde present in the porous fiberglass material after the binder is substantially cured. It is believed that the process disclosed in the '371 application has not been used commercially for at least this additional reason.

It is surprising that the present invention has been shown through recognized industrial testing methods to significantly reduce formaldehyde emissions in a matter of days or, at the outside, weeks. This is in marked contrast to the fact that formaldehyde emissions typically do not dissipate from an untreated product for months or years. An example of this marked difference in formaldehyde emissions over time is illustrated in the Examples and Figures herewith.

In a further aspect, the invention comprises a formaldehyde scavenger-emitting sheet material that is placed in contact or in the vicinity of a porous fiberglass material having a substantially-cured formaldehyde-emitting binder thereon, wherein the porous fiberglass material comprises formaldehyde emissions. In this form, the formaldehyde scavenger-containing sheet material can comprise paper or fabric that has been coated or saturated with a formaldehyde scavenger material. At this time, the inventors contemplate that paper or fabric can be contacted with an aqueous solution comprising a formaldehyde scavenger.

The formaldehyde scavenger can be applied to the sheet material by wetting or saturating the sheet material with an aqueous solution comprising formaldehyde scavenger. When a suitable paper is selected, the inventors have found that up to about 30 or 40 or 50% or more (depending on the absorptive properties of the sheet material itself) by weight scavenger can be added to the paper. (That is, if the paper weighs 70 grams, the paper would measure 100 grams with the formaldehyde scavenger added thereto.) The concentration of formaldehyde scavenger in the aqueous material used to treat the sheet material is limited only by the solubility of the formaldehyde scavenger in water. In one example, a 40% aqueous solution of formaldehyde scavenger was used to provide a 30% pick up on sheet materials including tissue paper and fluff pulp.

Appropriate wet strength for the sheet material means that the sheet material has suitable wet strength to pick up the formaldehyde scavenger-containing solution and to maintain its structural integrity throughout the remainder of the manufacturing and distribution process.

The wet strength of the sheet material can be from about 200 to about 10,000, or from about 500 to about 8,000 or from about 800 to about 6,000, or from about 800 to about 4,000, where the wet strength is measured in g/3-inches.

The basis weight of the sheet material can be from about 10 to about 500, or from about 10 to about 300, or from about 20 to about 200, or from about 20 to about 100 pounds/3000 $ft^2$.

Since the sheet material will be required to absorb liquid in a suitable amount, the absorbancy of the sheet material can also be relevant. In one aspect, the water absorbency can be from about 1 to about 100, or about 1 to about 80, or from about 3 to about 80, or from about 5 to about 40 grams of liquid/1 gram of sheet material.

The liner that is used in some forms of porous fiberglass material can also be treated with the formaldehyde scavenger to reduce waste.

The formaldehyde scavenger-containing sheet material can be placed in a location that is partially or totally isolated from the external environment so as to maintain the scavenger in close vicinity of the porous fiberglass material being treated. This can be accomplished by placing the sheet material into a package (e.g. bag or box) containing the porous fiberglass material. However, the package need not be hermetically sealed in order for the formaldehyde scavenger to be effective. As discussed elsewhere herein, porous fiberglass material packages (such as those used to package insulation) intentionally contain holes to facilitate packaging, shipping, and storage. Thus, the ability of the formaldehyde scavenger treatment to work even in a somewhat open environment makes the invention herein particularly suited for commercial use.

Moreover, the inventors herein have further been surprised that the formaldehyde emissions stay low even after the formaldehyde scavenger-containing sheet material is removed from the porous fiberglass material. One of ordinary skill in the art would expect that when the scavenger-containing sheet is removed from the porous fiberglass material, formaldehyde emissions would continue because formaldehyde-emitting materials will typically emit formaldehyde for an extended period of time. It was unexpected that the scavenger-containing sheet was successful in substantially reducing formaldehyde emissions from a porous fiberglass material, when the scavenger-containing sheet has been left in contact with the porous fiberglass material for a relatively limited period of time. Without being bound by theory, it is possible that the presence of a formaldehyde scavenger in the environment of the binder sets up a diffusion gradient. This, in turn, could result in an efficient reduction of formaldehyde when removal of formaldehyde occurs over a short period of time. This difference is exhibited in an unexpectedly fast emissions decay rate. In contrast, formaldehyde emissions may be slower if there is no diffusion gradient present. It is believed that the methods of the present invention are able to substantially reduce in fairly short time free formaldehyde from a porous fiberglass material having a substantially-cured formaldehyde emitting binder thereon.

In one aspect, the scavenger-containing sheet will substantially reduce formaldehyde emissions from a formaldehyde-emitting porous fiberglass material within about 30 days. Still further, the scavenger-containing sheet will substantially reduce formaldehyde emissions from a formaldehyde-emitting porous fiberglass material within about 14 days. Yet fiber, the scavenger-containing sheet will substantially reduce formaldehyde emissions from a formaldehyde-emitting porous fiberglass material within about 7 days.

Further, the inventors herein were surprised to discover that the formaldehyde scavenger-containing sheet material was highly effective on duct board and molded insulation. Specifically, duct board and molded insulation products are relatively dense (but still less than the 350 Kg/m$^3$ density that forms an upper limit of the present invention). These materials also have relatively high amounts of formaldehyde-emitting binder (as measured by LOI). Effectiveness of the formaldehyde scavenger treatments of the present invention on duct board and molded insulation are shown in the Examples.

In further aspects of the present invention, the formaldehyde scavenger can also be applied to any substrate such as paper, fabric, any type of mat, cardboard, boxing materials, bags, fibers of any type, textiles, etc. The formaldehyde scavenger can be applied to packaging materials such that the manufacturer would place the formaldehyde emitting products into the packaging. En route to the customer, the packaging could absorb any formaldehyde in the product. The customer would then discard the packaging and have a product which had little or no remaining formaldehyde emissions. Packaging materials included but are not limited to boxes, packing papers, envelopes, wrapping materials, bags, etc. Still further, the scavenger could be placed into small packets, such as those used for desiccants, made from "breathable" materials such that the formaldehyde scavenger could absorb formaldehyde from the environment. Still further, the formaldehyde scavenger could be used by including the formaldehyde scavenger with an absorbent (or adsorbent) material to which the scavenger will absorb (or adsorb). In one example, cellulose fibers can be treated with the formaldehyde scavenger. The formaldehyde scavenger treated cellulose fiber can be mixed with a porous fiberglass material to scavenge formaldehyde.

The scavenger can also be loaded onto an inert carrier material, such as by coating or absorbing the scavenger, for example using an aqueous solution, onto sepiolite, activated carbon, activated carbon fibers, zeolite, activated alumina, vermiculite, diatomaceous earth, perlite particles or cellulose fibers, with the scavenger-loaded inert material then being added to the porous fiberglass material. Finally, the scavenger could be added to the insulation package before shipment and storage for ultimate distribution to the consumer. This scavenger addition can be done by using the scavenger in any of its available forms, as a solid, liquid or gas.

FIG. 1 schematically illustrates, in one pertinent part, a process for overspraying a porous fiberglass material with an aqueous formaldehyde scavenger. (For completeness, a process of making a porous fiberglass material, here fiberglass insulation, is also shown.)

As illustrated schematically in FIG. 1, the manufacture of fiberglass insulation can be accomplished using continuous processes wherein molten glass flows from a melting furnace (110) is divided into streams (111) and is attenuated into fibers (112). The fiber attenuation generally is performed by centrifuging the molten glass though spinners (113) or by fluid jets (not shown) to form discontinuous glass fibers (112) of relatively small dimensions.

A curable binder composition is generally formulated as a liquid and is applied usually by spraying (114) or fogging onto the hot glass fibers emerging from the fiber attenuation mechanism. The resin-treated fibers then are collected as they are randomly deposited on a moving foraminous conveyor belt (115). The dynamics of the binder application are such that much of the water in the binder is evaporated as the hot fibers are cooled by contact with the aqueous binder. The resin binder then becomes tacky holding the mass of fibers together as the resin begins to set. The fibers are collected on a conveyor belt (115) in a generally haphazard manner to form a non-woven mat (116). The depth (thickness) of the fibers forming the mat is determined by the speed of fiber formation and the speed of the conveyor belt (115). The porous fiberglass material can be formed as a relatively thin product of about ⅛ to ¼ inch or it can be formed as a thick mat of 6 to 8 inches or even significantly more. Depending on formation conditions, the density of the product also can be varied from a relatively fluffy low density product to a higher density of 6 to 10 pounds per cubic foot or more, as long as the density of the fiberglass product is not greater than about 350 Kg/m3, which number forms the upper limit of the efficacy of the formaldehyde scavenger treatment of the present invention.

As shown in FIG. 1, an aqueous mixture consisting essentially of a formaldehyde scavenger is sprayed onto the resin-treated fibers using a sprayer 119 following their collection onto the conveyor 116 and prior to their entering into the oven 117. By spraying an aqueous mixture of a formaldehyde scavenger in this manner, the fibers are at least partially coated with a layer of scavenger.

Figure 2:
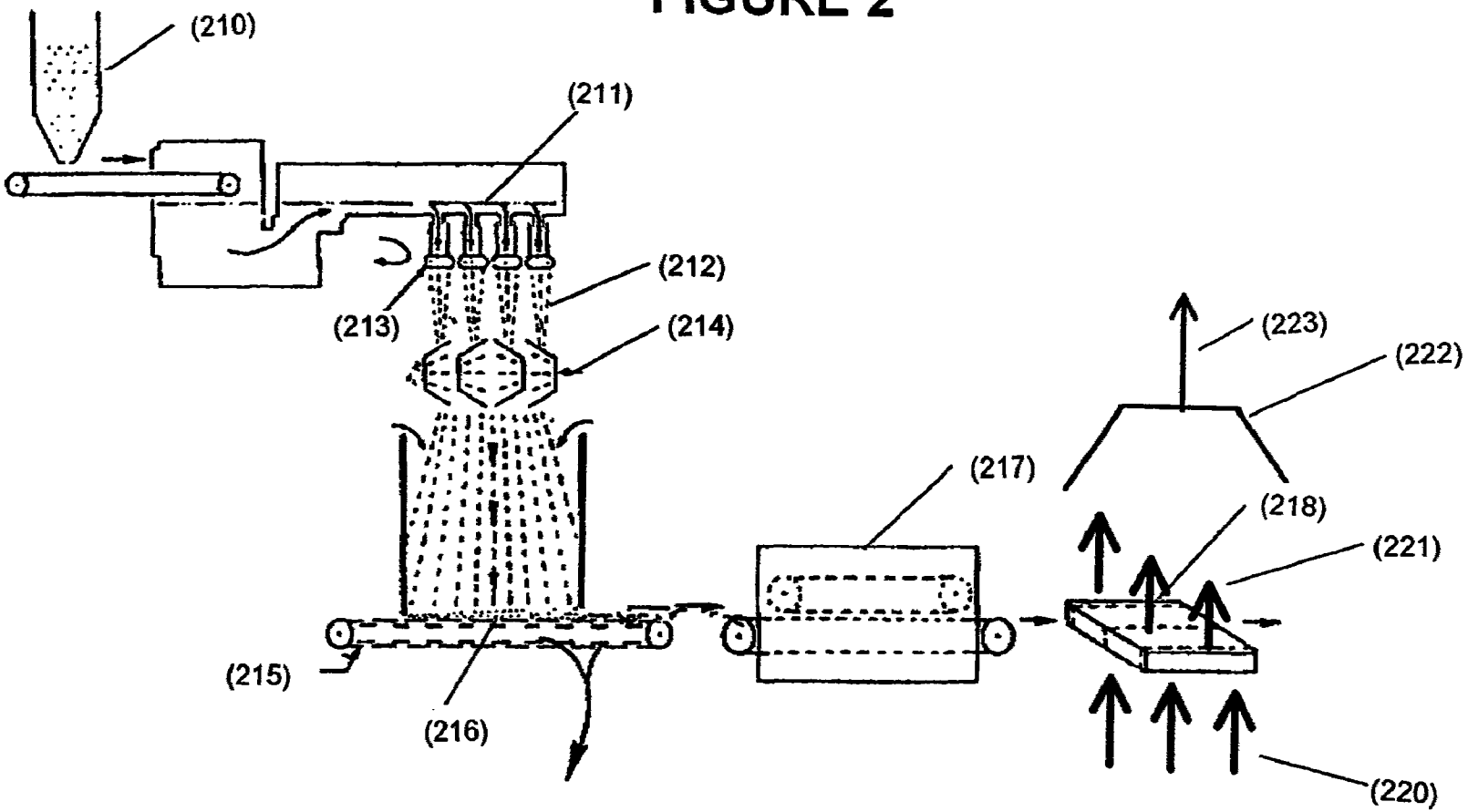
FIG. 2 illustrates an alternative embodiment of a method of making fiberglass insulation having a reduced tendency to emit formaldehyde in accordance with the present invention.

Turning now to FIG. 2, another aspect of the formaldehyde scavenger overspray is illustrated. The FIG. 2 embodiment differs from the process of FIG. 1 in that the treatment with the formaldehyde scavenger occurs after the porous fiberglass material has passed through the oven (217) wherein the formaldehyde-containing binder in the mat may be fully cured to form an integral composite mat structure (218). While mat (218) is shown schematically in FIG. 2 as a finite element or discrete sheet, the mat could be continuous such that it is eventually wound in roll form for shipment or storage as understood by those skilled in the art.

The process of FIG. 2 is particularly useful where the formaldehyde scavenger is supplied as a gas, such as ammonia or sulfur dioxide. As shown, the formaldehyde scavenger (220) is flowed into and eventually through the porous fiberglass material with the product from the reaction between the scavenger and free formaldehyde typically remaining behind in the mat and any unreacted scavenger (221) passing though the mat where it is collected, such as using a hood assembly (222). The collected stream of unreacted scavenger can then be passed, via conduit (223), for disposal or reuse. For example, if sulfur dioxide is used as the scavenger, unreacted scavenger gas could be treated with an aqueous lime slurry to produce calcium sulfate which then could be used for making gypsum. These recovery features form no part of the present invention and a variety of techniques could be used for recovering or disposing of any unreacted scavenger. The diagram shows the scavenger moving upwards through the mat. Alternatively, the scavenger could be directed downwards through the blanket as is typical in the cooling section. In the cooling section, the cooling air stream would collect unreacted scavenger which could then be treated in the exhaust air stream if needed. It may also react with other emissions in this air stream such as formaldehyde and/or ammonia.

In fiberglass insulation products, as well as other porous fiberglass materials that incorporate formaldehyde-containing binders (which also are included in this invention), heat resistant fibers generally are bonded together into an integral structure with an aqueous curable binder, typically an aqueous formaldehyde-containing resin. One particularly prevalent resin within the group of formaldehyde-containing resins is the heat curable, i.e., thermosetting, resin systems of the phenol-formaldehyde (PF) type. Included within this group also are PF resins that have been modified by the addition of urea (PFU resins). These resins are typically synthesized in an aqueous reaction medium under alkaline reactions conditions, generally established using an alkali metal hydroxide and especially sodium hydroxide. In making these resins, phenol is reacted with a molar excess of formaldehyde, normally to a very low level of residual phenol. In the case of PFU resins, an amount of urea basically in an amount sufficient to react with the residual formaldehyde is subsequently added and is reacted, typically for about 4 to 16 hours. (This reaction with urea is normally conducted at the site of the porous fiberglass material manufacturer.)

Another prevalent type of formaldehyde-containing resins often used in making porous fiberglass materials is the thermosetting urea-formaldehyde (UF) resins. UF resins are reacted (produced) under both alkaline and acidic conditions. UF resins used in binder formulations for making fiberglass products, such as air filters that may be about one inch thick, also are commonly cured under acid conditions using a latent acid catalyst such as triethylamine sulfate.

Such binders provide a strong bond between fibers with sufficient elasticity and thickness recovery to permit reasonable shipping and in-service deformation of the fibrous products, such as fiberglass insulation and filter products.

Such formaldehyde-containing binders are generally provided as water soluble or water dispersable compositions which can be readily blended with other ingredients (such as ammonium sulfate which is used as a cure accelerator or catalyst) and diluted to low concentrations that are readily sprayed (214) or fogged onto the hot fibers as they drop onto the collecting conveyor belt (215). Generally an amount of binder is applied sufficient to fix the position of each fiber in the mat by bonding fibers where they cross or overlap. Using binders with good flow characteristics allows the binder to flow to these fiber intersections. Thus, the binder composition is generally applied in an amount such that the cured binder constitutes about 1% to about 20% by weight, or, more usually, about 3 to 12% by weight of the finished fibrous product. The level of binder usage is not a limiting feature of the present invention. However, the amount of binder used can affect the amount of formaldehyde emissions. Porous fiberglass materials having a higher amount of binder may therefore be benefited by addition of additional formaldehyde scavenger. The amounts of formaldehyde scavenger useful in the present invention are discussed in more detail herein.

In one example of the manufacture of porous fiberglass materials, the formaldehyde-containing binder for making fiberglass insulation can be prepared by diluting with additional water a formaldehyde-containing resin from a higher solids content to an aqueous mixture of a relatively low solids concentration at from about 3 to about 40% by weight solids for applying to, such as by spraying or fogging, the hot fibers. The actual solids content of the binder is not a limiting feature of the present invention.

The porous fiberglass material (216) can then be compressed and shaped into a desired thickness as it is passed through a curing oven (217) where the binder is cured, thus fixing the size and shape of the cured porous fiberglass product by bonding the mass of fibers together to form an integral composite structure (218) (shown schematically in FIG. 2 as a finite element or sheet, but it could be a continuous product that is wound in roll form for shipment or storage, or it could be cubed or ground to produce a blowing wool product as understood by those skilled in the art).

In addition to radiant curing ovens, radio frequency and microwave heaters can also be used to cure the porous fiberglass material. The present invention is not to be limited to any particular way for curing the formaldehyde-containing binder on the porous fiberglass material.

As noted above, in the making of porous fiberglass materials, such as fiberglass insulation, the binder composition can be formulated into a dilute aqueous solution and then is usually applied, such as by spraying, onto the fibers. Binder compositions containing from about 3% by weight to about 60% by weight solids are typically used for making porous fiberglass products, including fiberglass insulation. Usually binder contents fall within the range of 3% to 25%.

The aqueous binder can be blended with other ingredients commonly used in binder compositions for preparing porous fiberglass materials, and the binder can be diluted to a low concentration which is readily applied onto the fibers, such as by spraying or fogging. For example, to prepare a binder composition, it may be advantageous to add a silane coupling agent (e.g., an organo silicon oil) to the binder mixture in an amount of at least about 0.02 wt. % based on the weight of binder solids. Suitable silane coupling agents (organo silicon oils and fluids) have been marketed by the Dow-Corning Corporation, Petrarch Systems, and by the General Electric Company. Their formulation and manufacture are well known such that detailed description thereof need not be given. This invention is not directed to and thus is not limited to the use of any particular silane additives.

"Dedusting" oil to minimize dust formation in the porous fiberglass manufacturing process can also be used. Such dedusting oils are typically high boiling point mineral oils. Ammonia and ammonium sulfate (a cure accelerator or latent acid catalyst) can also be added. Owens-Corning also adds dye to the binder formulation to color the product pink for product identification and trademark purposes. Other pigments, such as carbon black, also may be added. This invention is not directed to and thus is not limited to the use of any such additives or pigments.

The binder composition can be prepared by combining the aqueous formaldehyde-containing resin binder and the silane coupling agent, urea, dedusting oil, ammonium sulfate, dyes, pigments and other optional ingredients in a mixing procedure carried out at ambient temperatures. The binder composition can be used immediately after suitable preparation and may be diluted with water to a concentration suitable for the desired method of application, such as by spraying or fogging onto the fibers.

After the binder is applied to the porous fiberglass material, heat is applied to effect drying and curing. In the aspect shown in FIG. 2, after the initial portion of this heating (primarily drying) that occurs as a result of the transfer of heat from the hot fibers to the aqueous binder applied to the fibers (as the recently formed hot glass fibers are cooled by the aqueous binder), the mat is passed through an oven (217). The duration and temperature of the heating in the oven will affect the rate of drying, processability and handleability, degree of curing and property development of the resulting porous fiberglass material. The curing temperatures are typically from about 100 to about 300° C. and the curing time will typically be somewhere between 3 seconds to about 15 minutes. Other temperatures and times can be used depending upon particular binder formulations and the present invention is not limited to any specific set of conditions as it relates to the curing aspects of the porous fiberglass manufacturing process.

On heating, residual water present in the binder composition evaporates, and the composition undergoes curing, as such term is defined elsewhere herein.

The drying and curing functions may be carried out in two or more distinct steps, if desired. For example, the composition may be first heated at a temperature and for a time sufficient to substantially dry but not to substantially cure the binder composition and then heated for a second time at a higher temperature and/or for a longer period of time to effect curing (thermosetting). Such a preliminary "drying" procedure, generally referred to as "B-staging", may be used to provide binder-treated product, for example, in roll form, which may at a later stage be cured, with or without forming or molding into a particular configuration, concurrent with the curing process. This makes it possible, for example, to produce binder-impregnated semifabricates which can be molded and cured elsewhere.

Irrespective of whether a one or two-stage drying and curing process is conducted, the formaldehyde scavenger is not applied to the porous fiberglass material until after the resin is substantially cured, as such term is defined elsewhere herein.

The binder content of the fibrous porous fiberglass material could be found to have an effect on the efficacy of the formaldehyde scavenger treatment and the attendant amount of formaldehyde scavenger such as bisulfite required to obtain sufficient reduction in formaldehyde emissions. The inventors currently believe that the amount of formaldehyde scavenger will have to be varied for different fibrous porous fiberglass materials. One way of measuring the amount of binder in a fibrous fiberglass product is to classify the loss on ignition.

The overspray (that is, the aqueous, neat or gaseous formaldehyde scavenger) can be applied using methods other than spraying such as that shown in FIGS. 1 and 2 as discussed before. For example, the overspray can be applied to the porous fiberglass material having substantially cured binder thereon by curtain coating, by roll coating, by dipping and the like.

Further, the overspray (again, the aqueous, neat or gaseous formaldehyde scavenger) can be applied at multiple locations, as long as the overspray is applied after the binder is substantially cured on the porous fiberglass material. In particular, immediately after or shortly after the porous fiberglass material (i.e., the material is still warm from the oven) has emerged from the curing oven, in the cooling area and up to and including the point that the product is being packaged for distribution. For example, for blowing wool products, where the original mat may be ground or cubed to make the blowing wool product, the formaldehyde scavenger overspray could be mixed with the blowing wool as it is being cubed, ground, transferred into its packaging, or even after packaging such as by insertion and/or injection.

In some aspects where the formaldehyde scavenger can be melted under commercially relevant conditions, the formaldehyde scavenger overspray can be a solid or the solid can be melted to produce a molten liquid and the present invention contemplates applying such neat forms of the formaldehyde scavenger to the porous fiberglass material separate from application of the formaldehyde-containing resin binder to the fibers.

There is some indication that the performance of the formaldehyde scavenger applied in accordance with the present invention may be improved by the presence of moisture. In cases where the scavenger is applied as an aqueous solution and dried, applicants suspect that residual moisture in the dried scavenger coating may assist the formaldehyde reducing performance of the scavenger. Nonetheless, the inventors here do not believe that moisture needs to be added as part of the treatment of the fibers or mat, since they believe that the humidity available in the ambient environment provides a sufficient level of moisture in the porous fiberglass material for the scavenger to have a positive effect on formaldehyde emissions.

The inventors herein have observed that when using sodium bisulfite as a scavenger for fiberglass insulation made with PFU resin binder that the presence of the sodium bisulfite scavenger has an ameliorating effect on color development observed in the mat. In particular, mats having a cured PFU resin binder may be characterized as a dark or dingy yellow color. When such mats are treated with a sodium bisulfite scavenger, the yellow color becomes lighter or more muted as the level of treatment increases. One benefit of this effect is that it becomes easier to color the mat a different color (such as pink or blue) by supplying a dye or pigment as part of the manufacturing process. Less treatment is needed to color the more lightly colored mats obtained following sodium bisulfite scavenger treatment.

Applicants have also observed that when using sodium bisulfite as a scavenger for fiberglass insulation made with PFU resin binder, the presence of the sodium bisulfite scavenger also has the beneficial effect of reducing amine odors commonly present in fiberglass insulation products. While we do not want to be bound by any particular explanation, it is believed that free amines commonly present in insulation, such as trimethylamine, are neutralized by the acid in or created as a by-product by the scavenger, thus preventing the amines from being released as a VOC and odor causing agent. This result is especially beneficial because amines, especially trimethylamine present in the insulation product emit a very offensive fishy odor. Minimizing or eliminating this odor with an acid such as a bisulfite or a gas such as sulfur dioxide is highly desirable.

When making glass fiber products, such as fiberglass insulation, usually about 99 to about 60% by weight of the product will be composed of glass fibers or other heat resistant fibers, while the amount of binder solids will broadly be in reverse proportion ranging from about 1 to about 40%, depending upon the density and character of the product. Glass insulations having a density less than one pound per cubic foot may be formed with binders present in the lower range of concentrations while molded or compressed products having a density as high as about 30 to about 40 pounds per cubic foot can be fabricated of systems embodying the binder composition in the higher proportion of the described range.

Glass fiber products can be formed as a relatively thin product, such as a mat having a thickness of about 10 to about 50 mils; or they can be formed as a relatively thick product, such as a blanket of about 12 to 14 inches or more. The present invention is particularly useful for use in connection with the manufacture of fiberglass insulation products. The time and temperature for cure for any particular fiber product will depend in part on the amount of binder in the final structure and the thickness and density of the structure that is formed and can be determined by one skilled in the art using only routine testing. For a structure having a thickness ranging from 10 mils to 1.5 inch, a cure time ranging from several seconds to 1 about 5 minutes usually will be sufficient at a cure temperature within the range of about 175° to about 300° C. Other temperatures and times can also be used as being within the skill of the art.

Treatment of this full range of fibrous products is contemplated by using a formaldehyde scavenger in either a neat form or as an aqueous mixture consisting essentially of a formaldehyde scavenger.

Figure 3:
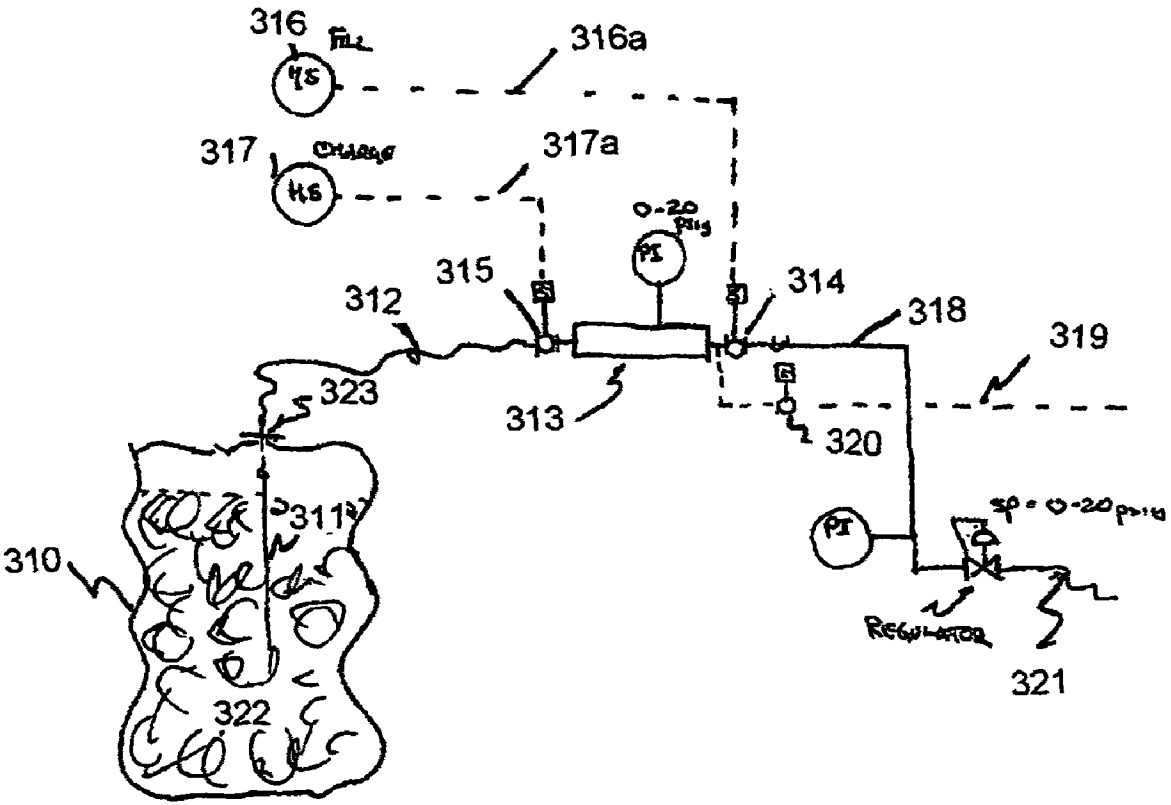
FIG. 3 illustrates one embodiment of the gaseous overspray application.

Illustrated schematically in FIG. 3 is one representative apparatus designed to implement a significant aspect of the gas overspray aspect of the present invention. As shown in FIG. 3, an enclosed space or container volume constituting bag 310 is filled with a fiberglass insulation product 322. The bag 310 has inserted into it an injection lance 311 for delivering the gaseous scavenger. Bag 310 may be made from one of a variety of plastic films such as polypropylene, polyethylene, polyvinyl chloride, polyester and the like. Lance 311 may have an opening at its end and may be provided with a tapered end to facilitate its entry into the enclosed space. Alternatively, lance 311 may have a series of openings (not shown) along its length to distribute the scavenger gas more uniformly throughout the contents of the bag. In yet another embodiment (not shown), several lances may be used, instead of a single lance as shown in the schematic drawing, in order to obtain a better distribution of the scavenger gas in and throughout bag 310. These and other such variations are within the skill of the ordinarily skilled worker.

A seal plate and gasket combination 323 can optionally be used if there is a desire to ensure that the connection between the lance 311 and bag 310 is sealed, or is substantially airtight. Testing has shown that such sealing may not be necessary. Other ways of establishing a seal between the gas injector (e.g., lance 311) and the enclosed space or bag 310 will be apparent to those skilled in the art. The bag of insulation may be of a loosefill insulation of the type marketed by Guardian as Supercube II® or by Owens-Corning as Advanced ThermaCube Plus®, it also may be a roll of insulation, insulation batt, or it may take another form, such as duct board.

The injection lance 311 is connected by a gas hose 312 to a gas charge container 313. The gas charge container may simply be a suitably sized cylinder. Other arrangements for supplying a set, fixed amount of a gaseous scavenger into the enclosed space will be evident to a skilled worker. Flow of gas into and out of the gas charge container 313 is regulated in part by solenoid valves 314 and 315, whose operation is controlled by controllers 316 and 317 via control lines 316*a* and 317*a*, respectively. For safety, the operation of these valves should be interlocked so that sulfur dioxide is not inadvertently discharged through the system when the gas charge container is being filled. On the inlet side of the gas charge container 313 is gas supply tubing 318, which is connected to a gas supply source 321, such as a gas cylinder (not shown) containing the gaseous formaldehyde scavenger, such as sulfur dioxide or ammonia. Gas flow into the bag could also be accomplished using a cylinder with a plunger. The gas also could be delivered by having a plunger assembly push the gas into the bag. This and other injection methods will be evident to skilled workers.

As will be described below, the formaldehyde scavenger may be supplied as a mixture of the active scavenger gas and an inert carrier or dilution gas. An alternative gas supply line 319 is shown in shadow in FIG. 3. The gas supply line 319 is controlled by a solenoid valve 320 and a solenoid controller not shown, for supplying a source of carrier or dilution gas in the event that the gas supply of scavenger from source 321 through gas supply tubing 318 is not supplied premixed with a carrier or dilution gas.

The system operation is very straightforward. Gaseous scavenger, preferably gaseous sulfur dioxide (or a premix of gaseous sulfur dioxide and a carrier gas such as nitrogen) is supplied from a gas supply source 321, such as a pressurized gas cylinder, to the gas charge container 313 by opening the inlet solenoid valve 314 on the pressurized side of the container 313. The flow of gas into the container 313 is stopped by a preset pressure controller 316 at the pressure providing the desired quantity of the charge. At this point, the inlet valve 314 is closed. The contained gas can thereafter be charged, or injected, into the enclosed space, such as bag 310, containing the fibrous insulation product to be treated with the scavenger. This is accomplished by placing the injection lance 311 into the receptacle 310 containing the insulation product (as shown) and opening the outlet container valve 315. The lance can be inserted into an opening of the bag before it is sealed for subsequent, storage, distribution and sale. It also is possible to insert the lance 311 after the bag has been readied for storage, distribution and sale simply by piercing or puncturing the wall of the previously sealed bag with lance 311. This allows the gas to expand into the receptacle 310 through supply tubing 312 and the lance 311. The outlet valve 315 is then closed, and the cycle repeated for subsequent injections of gaseous scavenger into additional bags of insulation.

As the injection lance is removed from a bag 310 (if provisions for securing the lance are not otherwise provided), some residual sulfur dioxide gas may escape from the lance 311 and tube 312 into the surrounding environment. If this is undesired, this result could be prevented by providing a separate fugitive gas collection system (not shown) for the lance as it is removed from the treated bag 310. Alternatively, the apparatus also could be adapted to perform a separate cycle step in which an interim charge of an inert carrier gas (e.g., a short blast of compressed air or nitrogen) is provided after the charge of gaseous scavenger, in order to purge residual scavenger, e.g., sulfur dioxide, from the supply tube 312 and the lance 311 into the receiving receptacle 310. For example, this could be accomplished using supply line 319 and solenoid 320 in combination with solenoid 315, as will be recognized by a skilled worker.

Materials to be used in constructing the injection system schematically illustrated in FIG. 3, suitable for handling the desired scavenger gas, be it the sulfur dioxide or ammonia, will be apparent to a skilled worker and need not be identified in the present application. Suffice it to say that the corrosive nature of such gases may necessitate a proper selection of materials of construction to ensure extended trouble-free operation. Such features are within the skill of the ordinarily skilled worker.

Figure 4:
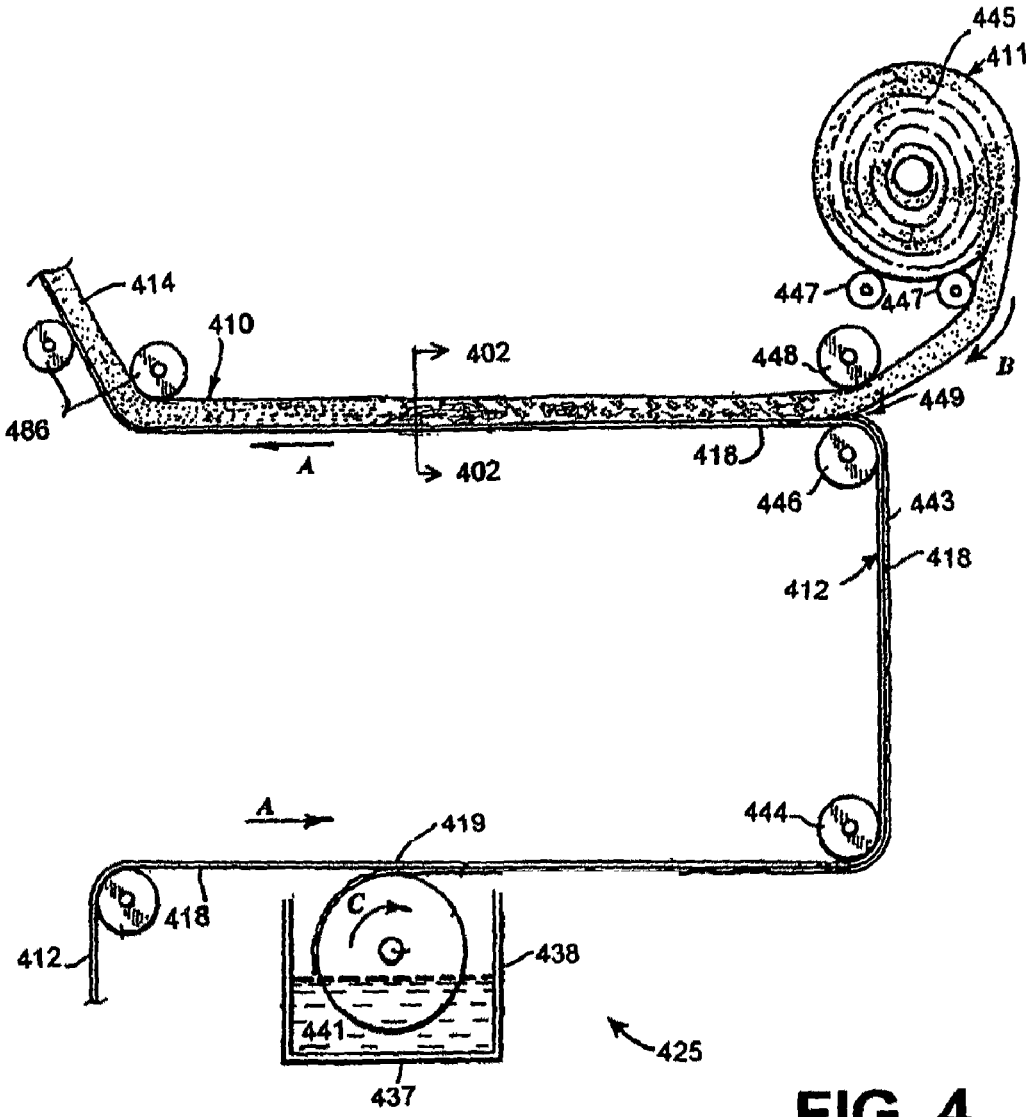
FIG. 4 illustrates one embodiment of the formaldehyde scavenger-treated sheet material application.

Referring to FIG. 4, a sheet of backing material 412 is advanced along its length from a supply, typically provided as a roll of the material (not shown), in the direction indicated by arrow A. The backing sheet material passes over an adhesive applicator 425 that engages a surface of the backing sheet and applies an adhesive material to a surface 418 of the backing sheet. In aspects where the backing sheet does not already carry a formaldehyde scavenger composition, the adhesive composition 441 in adhesive reservoir 438 may also contains a formaldehyde scavenger, so that both an adhesive for affixing the backing sheet 412 to the fiberglass mat or blanket 411 and a formaldehyde scavenger are simultaneously applied to the backing sheet 412. Alternatively, there could be a separate step where the formaldehyde scavenger is applied to the backing sheet 412, such as by use of a sprayer, before it engages the fiberglass mat or blanket 411.

The backing sheet 412 is advanced around a pair of guide rollers 444 and 446 which reorient the backing sheet 412 such that the adhesively coated surface of the backing sheet (and the surface that carries the formaldehyde scavenger composition) 418 faces upwardly towards a fiberglass mat or blanket 411, which is advanced along its length from another supply, roll 445, onto the adhesively coated surface 418 of the backing sheet 412 so that the backing sheet 412 and blanket or mat 411 become adhesively attached.

The fiberglass mat or blanket supply roll 445 rests on feed rolls 447, and the mat or blanket material 411 advances along its length feeding a substantially continuous length of fiberglass mat or blanket material 411 into contact with the adhesively coated surface 418 of the backing sheet 412. A blanket guide roller 448, about which the fiberglass blanket 411 passes, is positioned parallel to upper guide roller 446, between upper guide roller 446 and the fiberglass blanket feed rollers 447. The blanket guide roller 448 guides the fiberglass blanket 411 into contact with the adhesively coated surface 418 (and the surface that carries the formaldehyde scavenger composition) of the backing sheet 412 as indicated at 449.

Figure 5:
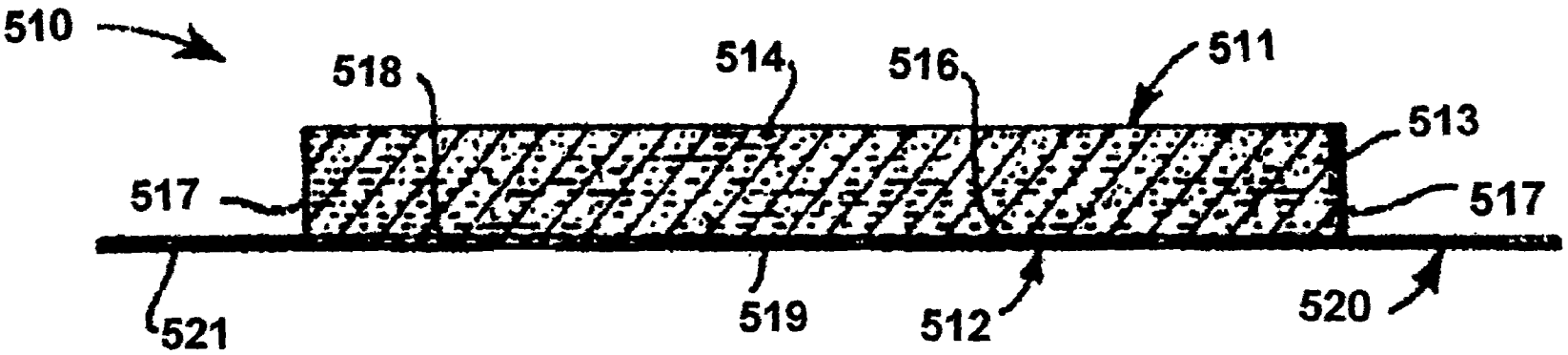
FIG. 5 is a side view of a lined backing sheet made in accordance with FIG. 4.

FIG. 5 illustrates, in cross-section taken along line 402-402 of FIG. 4, a sheet of fiberglass insulation 510 constructed according to the present invention by affixing a backing sheet 512 to a fiberglass mat or blanket 511 made with a formaldehyde-containing resin binder. In this embodiment, the fiberglass mat or blanket 511 has a rectangular cross-section with an upper surface 514, a lower surface 516 and opposed parallel side surfaces 517. The fiberglass blanket 511 can be of almost any width so as to be compatible with the structure to which it is applied, and its thickness, for residential applications, usually will be from about 3 to about 24 inches.

In accordance with the present invention, the backing sheet 512 can be any of a wide variety of suitable materials for forming a flat, often flexible, support layer, film or foil, including for example paper, cardboard, fabric, plastic (such as Mylar, polyethylene or polyvinyl chloride), metal (such as aluminum), glass mat and other similar materials. The sheet is generally flexible, but has a sufficient degree of inherent stiffness so as to provide the fiberglass mat or blanket 511 with stability. In many cases the sheet is made from a plastic or metal film to make it vapor impervious. The backing sheet 512 often has an adhesively coated inner surface 518 for attaching it to the fiberglass mat or blanket 511, a back surface 519 and opposed parallel side edges 520 and 521. The back surface 519 of the backing sheet 512 can be covered with one or more additional layers of facing material if desired, such as a heavy gauge paper, particularly in those embodiments where a thin foil is used for an inner layer of backing sheet 512.

Indeed, the backing sheet can have a single ply construction, or can have a multi-ply construction. The backing sheet can be made from a single material or can be made from a mixture of the various substrate materials as, for example, identified above.

The backing sheet 512 has a width dependent on the width of fiberglass mat or blanket 511. Preferably, the side edges 520 and 521 of the backing sheet 512 extend outwardly a small distance beyond the side surfaces 517 of the fiberglass mat or blanket 511 to form tabs of the backing material which facilitate installation. The fiberglass mat or blanket 511 can be installed in roof or wall structures of various types of buildings to provide an insulation barrier for such structures, with the tabs of the backing sheet being attached to studs or other parts of the building structure.

In order to reduce the emission of formaldehyde from the fiberglass mat or blanket 511, the backing sheet 512 carries a formaldehyde scavenger composition. When using an impervious backing sheet material, the formaldehyde scavenger composition is coated on the inner surface 518 of the backing sheet. For porous backing sheets, the formaldehyde scavenger composition can either be coated on the inner surface 518, or can be impregnated though the thickness of the backing sheet 512. In this way, the formaldehyde scavenger composition is in a mass transfer relationship with the formaldehyde as it is emitted from the mat or blanket 511. While FIG. 5 shows a backing sheet situated on only one side of the mat or blanket 511, it is of course within the spirit of the present invention to provide a backing sheet on both sides of the mat or blanket 511. Testing has shown that when a sheet is treated with sodium bisulfite, a small amount of sulfur dioxide is released from the treatment sheet but levels are below standards as is shown in examples.

In relation to this aspect of the present invention where a formaldehyde scavenger-containing backing sheet is attached to the porous fiberglass material, as shown in FIG. 4, a sheet of backing material 412 is advanced along its length from a supply, typically provided as a roll of the material (not shown), in the direction indicated by arrow A. The backing sheet material passes over an adhesive applicator 425 that engages a surface of the backing sheet and applies an adhesive material to a surface 418 of the backing sheet. In embodiments where the backing sheet does not already carry a formaldehyde scavenger composition, the adhesive composition 441 in adhesive reservoir 438 may also contains a formaldehyde scavenger, so that both an adhesive for affixing the backing sheet 412 to the fiberglass mat or blanket 411 and a formaldehyde scavenger are simultaneously applied to the backing sheet 412. Alternatively, there could be a separate step where the formaldehyde scavenger is applied to the backing sheet 412, such as by use of a sprayer, before it engages the fiberglass mat or blanket 411.

The backing sheet 412 is advanced around a pair of guide rollers 444 and 446 which reorient the backing sheet 412 such that the adhesively coated surface of the backing sheet (and the surface that carries the formaldehyde scavenger composition) 418 faces upwardly towards a fiberglass mat or blanket 411, which is advanced along its length from another supply, roll 445, onto the adhesively coated surface 418 of the backing sheet 412 so that the backing sheet 412 and blanket or mat 411 become adhesively attached.

The fiberglass mat or blanket supply roll 445 rests on feed rolls 447, and the mat or blanket material 411 advances along its length feeding a substantially continuous length of fiberglass mat or blanket material 411 into contact with the adhesively coated surface 418 of the backing sheet 412. A blanket guide roller 448, about which the fiberglass blanket 411 passes, is positioned parallel to upper guide roller 446, between upper guide roller 446 and the fiberglass blanket feed rollers 447. The blanket guide roller 448 guides the fiberglass blanket 411 into contact with the adhesively coated surface 418 (and the surface that carries the formaldehyde scavenger composition) of the backing sheet 412 as indicated at 449.

It will be understood that while the invention has been described in conjunction with specific embodiments thereof, the foregoing description and following examples are intended to illustrate, but not limit the scope of the invention. Other aspects, advantages and modifications will be apparent to those skilled in the art to which the invention pertains, and these aspects and modifications are within the scope of the invention.

EXAMPLE 1 (COMPARATIVE)

Addition of Formaldehyde Scavenger to Cured and Uncured Binder

To simulate the manufacture of fiberglass insulation, batts were prepared in the laboratory. A roll of 1 inch thick, unbonded, fiberglass was obtained from Resolute Manufacturing (Atlanta, Ga.) and divided into individual sheets weighing about 30 grams each. The individual un-bonded fiberglass sheets were placed in a tray. A formaldehyde-emitting binder (as described below) was placed in a reservoir and air was used to aspirate the binder into a fine mist. The mist was drawn through each individual batt using an air exhaust hood. This technique caused fine binder droplets to be deposited onto and into the batt. In each run, approximately eight grams of binder was deposited onto each sample of the glass batt. Following binder application, the batt was next cured in a forced air oven for two minutes at 425° F. (218° C.) to cure the binder. After curing, the batt was transferred to a zipper-type storage bag. Each sample was tested in the DMC to measure product formaldehyde emissions. Formaldehyde was collected using 20 mls of 0.25N NaOH in an impinger with the air flow into the impinger set at 1.0 L/min. Subsequently, the impinger solutions were tested for formaldehyde emissions using a standard chromotropic acid method. The DMC testing methodology is described in detail in U.S. Pat. Nos. 5,286,363 and 5,395,494, the disclosures of which are incorporated herein in their entireties, especially for their disclosure of the DMC technique.

Two batt samples were prepared for each of the experiments and testing under two different treatments. In each case, the binder was formulated from an aqueous phenol-formaldehyde resin that is commercially available from Georgia-Pacific Chemicals, LLC as Resin 209G47. The aqueous resin was mixed with a 40% by weight aqueous solution of urea in an amount of 1 part urea solution per approximately 7 parts aqueous resin. The mixture was allowed to "pre-react" overnight at room temperature before the binder was applied to the batts. Shortly before application to the batts, an aqueous ammonium sulfate solution (20% by weight ammonium sulfate) was included as a cure accelerator or catalyst. The ammonium sulfate was added per approximately 1 part per 2 parts by weight of the binder to complete the base binder formulation.

In the Control, only the above-formulated binder (that is, no formaldehyde scavenger was added) was applied to the fiberglass batt. In a Comparative experiment, a formaldehyde scavenger (sodium bisulfite) was applied to the batt after the binder was applied to the batts but prior to curing. The scavenger was applied separately to the batts but before curing the binder using a spray bottle in an amount of 1 part scavenger (sodium bisulfite) per approximately 17.6 parts of the aqueous resin used in the binder (this corresponds to 1 part scavenger per approximately 9 parts phenol-formaldehyde resin solids).

The results of each of the two treatments were obtained from DMC testing (as discussed later) for each experiment, the average results and the levels of reduction in formaldehyde emission are reported in the Table below.

The results demonstrate that addition of formaldehyde scavenger into the uncured binder provided a modest improvement in the formaldehyde emissions of the fiberglass product after curing. However, addition of formaldehyde scavenger after the binder is applied, provides markedly reduced formaldehyde emissions.

Formaldehyde Emission Results (ppm Formaldehyde)

| | Control | Comparative 1 | Comparative A | Comparative B | Comparative C |
|---|---|---|---|---|---|
| Replicate 1 | 0.190 | 0.174 | 0.136 | 0.130 | 0.101 |
| Replicate 2 | 0.182 | 0.168 | 0.112 | 0.128 | 0.125 |
| Average | 0.186 | 0.171 | 0.124 | 0.129 | 0.113 |
| % Reduction from Control | — | 8.1 | 33.3 | 30.6 | 39.2 |

Control - No formaldehyde scavenger

Comparative 1 - formaldehyde scavenger added to uncured binder prior to application of the binder to the matt Comparative A, B, C - formaldehyde scavenger added to binder after binder applied to matt, but before curing

EXAMPLE 2

Review of Handsheet Strength as a Function of Formaldehyde Scavenger Addition A test was conducted to compare handsheet tensile strength of a standard phenol-formaldehyde resin/binder system to one that has been modified by adding salts such as sodium bisulfite. This Example demonstrates the loss of mechanical properties resulting from mixing a formaldehyde scavenger into the uncured binder as set forth in the '371 patent.

A series of binders was evaluated for handsheet tensile strength. Handsheets were made as follows. Premixes were prepared by mixing resin GP2894 and a 40% urea solution. The premix solutions were allowed to prereact overnight at room temperature. The binders were prepared by weighing the binder ingredients into a ½ gallon jar and mixing well. The modified binders were formulated to contain sodium bisulfite in an amount of 50% by weight percent of binder solids. Bisulfite solids were calculated as a percent of binder solids which are defined as phenolic solids plus urea solids. Handsheets were prepared by soaking the mat in binder, vacuuming the excess binder off the glass, and curing the sheet in an oven at the specified temperature. Handsheets with sodium bisulfite overspray were prepared as usual except a spray bottle was used to spray a 20% solution of sodium bisulfite onto the surface of the handsheet. Hot/wet tensiles were measured by soaking the handsheets in water at 185° F. for 10 minutes and then breaking them in a tensile tester while they were still hot and wet. Results are presented in the following table.

Premix and Binder Formulations:
Effect of Salt on Handsheet Tensile Strength:

Premix

| Resin | Grams Resin | Grams 40% |
|---|---|---|
| 2894 | 1647.06 | 900 |

Binders:

| Grams Premix | Grams Water | Grams Ammonia | Grams 20% Ammonium Sulfate | Grams Sodium Bisulfite | Grams 20% sodium bisulfite solution applied as overspray | Notes: |
|---|---|---|---|---|---|---|
| 509.41 | 909.59 | 13.5 | 67.5 | 0 | | 2894 Control Binder |
| 509.41 | 789.59 | 13.5 | 67.5 | 120 | | 2894 with 50% sodium bisulfite in binder |
| 509.41 | 909.59 | 13.5 | 67.5 | | 2.5 grams per sheet **See calc notes | 2894 with 50% sodium bisulfite overspray |

**Calculations to determine amount of bisulfite overspray:

| | | |
|---|---|---|
| Weight of typical handsheet: (dried) | 9 | grams |
| Typical LOI | 10% | % |
| Grams LOI | 0.9 | grams |
| Grams Sodium bisulfite | 0.45 | grams |
| Grams 20% bisulfite soln | 2.25 | grams |

Results:

| | 1<br>2894<br>Control | 2<br>2894<br>with SB<br>in<br>Binder | 3<br>2894<br>with SB<br>as<br>Overspray |
|---|---|---|---|
| 1 | 40.7 | 24.1 | 36.7 |
| 2 | 39.5 | 27.2 | 43.5 |
| 3 | 39.2 | 30.7 | 42.7 |
| 4 | 49.1 | 35.3 | 47.8 |
| 5 | 37.4 | 22.9 | 38.3 |
| 6 | 40.0 | 25.5 | 41.5 |
| 7 | 32.2 | 14.5 | 45.7 |
| 8 | 36.0 | 16.0 | 36.1 |
| 9 | 41.4 | 20.7 | 37.2 |
| 10 | 36.7 | 16.9 | 41.0 |
| 11 | 44.5 | 23.4 | 32.6 |
| 12 | 39.5 | 17.0 | 38.8 |

| | Descriptive Statistics (Spreadsheet1) | | | | | | |
|---|---|---|---|---|---|---|---|
| | Valid N | Mean | Confidence −95.000% | Confidence 95.000 | Minimum | Maximum | Std.Dev. |
| 2894 Control | 12.00 | 39.68 | 36.97 | 42.39 | 32.20 | 49.10 | 4.26 |
| 2894 with SB in Binder | 12.00 | 22.85 | 18.85 | 26.85 | 14.50 | 35.30 | 6.29 |
| 2894 with SB as Overspray | 12.00 | 40.16 | 37.39 | 42.93 | 32.60 | 47.80 | 4.36 |

The above results show the following:

A. Handsheet tensile strengths decreased significantly when large amounts of salts, such as 50% sodium bisulfite, were added into the binder.

B. Handsheet tensile strengths were not affected when the salts were added as an overspray to the binder-treated porous fiberglass material.

The above results are shown graphically in FIG. 6.

EXAMPLE 3

Blowing Wool with Solid Formaldehyde Scavenger Addition

This Example illustrates the results of the addition of a formaldehyde scavenger according to the present invention to a product having a formaldehyde-emitting binder thereon, where the binder is substantially cured. In this case, a commercially available blowing wool product (Owens Corning Advanced ThermaCube Plus® blowing wool (loose fill fiberglass) was encased in a substantially air-tight container or package with a formaldehyde scavenger composition.

A Control was prepared by closely placing 135 grams of the Advanced ThermaCube Plus® (hereinafter ATC+) blowing wool into a one liter Nalgene® bottle. The bottle then was sealed by closing the lid tightly.

To prepare a treated sample, 135 grams of the ATC+ blowing wool also was stuffed into a one liter Nalgene® bottle with 0.81 grams sodium bisulfite scavenger. The insulation was divided into 5 equal parts. One part (⅕ of the material) was placed into the Nalgene® bottle then 0.2 grams bisulfite was sprinkled into the bottle. This layering procedure of blowing wool and scavenger was continued until there were 5 layers of blowing wool insulation and 4 layers of bisulfite. Layers were alternated to maximize dispersion of bisulfite into insulation. The bottle then was sealed by closing the lid tightly.

After approximately six days, the formaldehyde emissions of the control and treated products were measured in the DMC (Dynamic Micro Chamber) using the Ceq test. The ATC+blowing wool samples were removed from the respective bottles and placed into a wire basket that was approximately 14"×21". The basket had a foil bottom to prevent the ATC+blowing wool from falling through the holes in the basket. The basket was made from wire mesh with holes that were approximately ½" wide. The basket was placed into the DMC and the Ceq test was conducted. In the Ceq test, air was circulated inside the chamber for 30 minutes with no air flow entering or exiting the chamber. After 30 minutes, the impinger was hooked to the chamber and the impinger was sparged with air from the chamber for 30 minutes at a rate of 1.0 liter per minute. Air exiting the impinger was returned to the DMC. Emissions were collected using 20 mls of 0.25N NaOH in the impinger. Impinger solutions were tested for formaldehyde emissions using the standard chromotropic acid method. The results are in the Table below as Control A and Treated sample A-1.

Following the initial testing, the samples were placed in paper receptacles open to the ambient environment and then re-tested on several more occasions (9 days—B and B-1; 12 days—C and C-1 and 22 days D and D-1). The results are presented in the Table below.

| Product Formaldehyde Emissions Results | |
|---|---|
| Sample | Ppb HCHO |
| Control A | 507 |
| Treated Sample A-1 | N.D. |
| Control B | 115 |
| Treated Sample B-1 | N.D. |
| Control C | 78.9 |
| Treated Sample C-1 | N.D. |
| DMC Chamber Air Blank | N.D. |
| Control D | 120 |
| Treated Sample D-1 | 47 |
| DMC Chamber Air Blank** | 37 |

N.D. means non-detectable.

**Note: On the day that Samples D and D-1 were tested there were a number of particleboard panels that were being conditioned in the DMC room. This likely explains why the air blank recorded a much higher formaldehyde level than usual. On that day, the air blank value should be subtracted from the readings on the ATC+ blowing wool samples to get the properly adjusted ATC+ sample values.

EXAMPLE 4

Examination of Formaldehyde Scavenger-Scavenger Paper on Formaldehyde Emissions from Insulation The effectiveness of sodium bisulfite treated paper to reduce formaldehyde emissions from commercially available R-13 fiberglass insulation was examined.

A fresh bag of Knauf R-13 unfaced insulation was obtained directly from Knauf Fiberglass. The insulation was cut into 8"×20" pieces upon receipt. The pieces were put immediately into zipper bags.

Formaldehyde emissions were measured for the following samples. Blotter paper samples were treated with solutions of sodium bisulfite as shown in the Table below. The treated samples were then dried in an oven the as shown in the Table below.

| Sample | Blotter Paper Treatment | Grams Treatment Chemical | Drying Conditions | Blotter Paper Observations |
|---|---|---|---|---|
| Control: | None | 0 | None | Dry |
| Aqueous Sodium Bisulfite Treatment | Aqueous 33.3% Sodium Bisulfite Solution | 21.20 | 1 minute at 70 C. | Damp |
| Aqueous Sodium Bisulfite Treatment | Aqueous 33.3% Sodium Bisulfite Solution | 20.00 | 1 minute at 70 C. | Damp |
| Sodium Bisulfite in Glycerine | 1:1 Mixture of Glycerine and 33.3% Aqueous Sodium Bisulfite Solution | 39.91 | 4 minutes at 105 C. | Oily Feel |
| Sodium Bisulfite in Glycerine | 1:1 Mixture of Glycerine and 33.3% Aqueous Sodium Bisulfite Solution | 40.80 | 4 minutes at 105 C. | Oily Feel |

After the above papers were prepared, each was cut in half to provide two 6"×12" pieces and transferred to zipper-type bags containing the R-13 samples. The samples were allowed to sit for 72 hours at ambient conditions. The samples were then tested in the DMC (Dynamic Micro Chamber) for formaldehyde emissions as discussed elsewhere herein.

Product Formaldehyde Emissions Results

| Sample | Impinger solution abs. #1 | Impinger solution abs. #2 | Impinger solution abs. #3 | Temp | Humidity | Air Flow inside DMC | ppb HCHO |
|---|---|---|---|---|---|---|---|
| Control R-13 Batts | 0.078 | 0.079 | 0.081 | 78.11 | 49.34 | 1.50 | 40 |
| Aqueous Sodium Bisulfite Solution | 0.002 | 0.002 | 0.001 | 76.38 | 59.98 | 1.48 | N.D. |
| Sodium Bisulfite in Glycerine | 0.007 | 0.005 | 0.007 | 78.74 | 40.58 | 1.49 | N.D. |

Subjective Observations on Batts

| Sample | Odor |
|---|---|
| Control R-13 Batts | Trimethylamine |
| Aqueous Sodium Bisulfite Solution | Sodium Bisulfite |
| Sodium Bisulfite in Glycerine | Sodium Bisulfite |

The above data show that treating the R-13 insulation samples with sodium bisulfite-treated paper reduced formaldehyde emissions to non-detectable levels when applied as an aqueous solution or as a solution in glycerine.

The above results are illustrated in FIG. 7.

EXAMPLE 5

Comparison of Bisulfite-Treated Paper Loadings on Formaldehyde Emissions

The effect of various sodium bisulfite-treated paper loading levels on formaldehyde emissions from R-13 fiberglass insulation was tested.

A fresh bag of R-13 unfaced insulation was obtained from Knauf Fiberglass. The insulation was cut into 8"×20" pieces upon receipt. The pieces were put immediately into plastic zipper-type bags. The Loss on Ignition (LOI) of the samples was estimated at 5%. The 8"×20" pieces were found to weigh approximately 110 grams. At 5% LOI, the grams organics on the samples was estimated at about 5.5 grams. Sodium bisulfite loading levels were calculated as a percent of LOI. Loadings were as follows:

| Sample | Grams LOI | Grams Sodium Bisulfite per sample | Sodium Bisulfite Solution Preparation: Grams 33.3% Sodium Bisulfite | Sodium Bisulfite Solution Preparation: Grams Water | % Sodium Bisulfite Solution Prepared to Treat Samples |
|---|---|---|---|---|---|
| Control | 5.5 | 0.000 | 0.0 | 200.0 | 0.00% |
| 1% Sodium | 5.5 | 0.055 | 3.3 | 196.7 | 0.55% |

-continued

| Sample | Grams LOI | Grams Sodium Bisulfite per sample | Sodium Bisulfite Solution Preparation: Grams 33.3% Sodium Bisulfite | Sodium Bisulfite Solution Preparation: Grams Water | % Sodium Bisulfite Solution Prepared to Treat Samples |
|---|---|---|---|---|---|
| Bisulfite Loading | | | | | |
| 10% Sodium Bisulfite Loading | 5.5 | 0.550 | 33.0 | 167.0 | 5.50% |
| 60% Sodium Bisulfite Loading | 5.5 | 3.300 | 200.0 | 0.0 | 33.3% |

Product formaldehyde emissions were measured for the following series of samples. 6"×6" paper samples were used. Papers were treated with aqueous solutions of sodium bisulfite as shown in the Table below, which were then dried in the handsheet oven at 40° C. for 1 minute. After oven drying, the papers were still slightly damp to the touch.

| Sample | Grams Water | Sodium Bisulfite Solution Concentration | Grams Sodium Bisulfite Solutions | Grams Weight left after drying |
|---|---|---|---|---|
| Control | 10.0 | | | 7.6 |
| Control | 9.8 | | | 7.4 |
| 1% Sodium Bisulfite Loading | | 0.55% | 10.9 | 8.1 |
| 1% Sodium Bisulfite Loading | | 0.55% | 10.5 | 7.8 |
| 10% Sodium Bisulfite Loading | | 5.50% | 10.8 | 8.2 |
| 10% Sodium Bisulfite Loading | | 5.50% | 11.9 | 9.3 |
| 60% Sodium Bisulfite Loading | | 33.3% | 11.9 | 9.7 |
| 60% Sodium Bisulfite Loading | | 33.3% | 13.0 | 10.6 |

The papers were then transferred to zipper-type bags containing R-13 samples. The samples were allowed to sit overnight at ambient conditions. The next morning, they were tested in the DMC (as described elsewhere herein) and subjective observations on the batts were also noted. Specifically, the color of each set of batts was noted. Also, when the bags were opened, they were checked immediately for odor.

Duplicate batts were placed into the chamber simultaneously. Air flow in the DMC was set at 1.5 liters/minute.

Subjective Observations on Batts

| Sample | Color | Odor |
|---|---|---|
| Control | Dingy Yellow Color | Trimethylamine |
| 1% Sodium Bisulfite | Light Yellow Color | Trimethylamine |
| 10% Sodium Bisulfite | Lighter Yellow Color | Trimethylamine |
| 60% Sodium Bisulfite | Lightest Yellow Color | Sodium Bisulfite |

The above data demonstrate the following:

Increasing the sodium bisulfite loading of the formaldehyde scavenger-treated paper decreased formaldehyde emissions.

At a 10% loading, emissions were reduced to approximately ⅓ of the control.

At a 60% loading, the formaldehyde emissions were non-detectable.

The results of this Example are illustrated in FIG. 8.

EXAMPLE 6

Emissions of Duct Board with Formaldehyde Scavenger-Treated Paper

A commercially available duct board having a formaldehyde-emitting binder substantially cured thereon was obtained directly from Knauf Fiberglass. The duct board was Product Formaldehyde Emissions Results

| Sample | Impinger solution absorbance #1 | Impinger solution absorbance #2 | Temp. | Humidity | Air Flow inside DMC | ppb HCHO |
|---|---|---|---|---|---|---|
| Control | 0.058 | 0.060 | 76.72 | 60.16 | 1.52 | 50.4 |
| 1% Sodium Bisulfite Loading | 0.076 | 0.076 | 76.15 | 60.14 | 1.53 | 70.4 |
| 10% Sodium Bisulfite Loading | 0.025 | 0.031 | 76.15 | 60.14 | 1.53 | 19.0 |
| 60% Sodium Bisulfite Loading | 0.002 | 0.002 | 76.13 | 60.00 | 1.52 | Non-Detectable |

encased in a substantially air-tight package with a substrate carrying a formaldehyde scavenger comprising a sodium bisulfite-treated paper.

Four pieces of the duct board measuring 8"×20" were cut and placed inside two Mylar® bags. Two pieces of the duct board were placed into each bag. Blotter papers were placed both outside of and between the pieces of duct board in alternating layers in the bag and then the bags were sealed.

For the Control, paper not having any sodium bisulfite applied thereto was used. For the formaldehyde scavenger-treated sample, the paper sheets were prepared by spraying the paper with a total of approximately 115 grams of a 33.3% sodium bisulfite solution per piece of duct board (for a total of about 230 grams of the 33.3% by weight sodium bisulfite solution onto all of the papers added into the bags). The treated paper was dried in an oven for 4 minutes at 105° C. before it was placed into the bags with the samples.

The sheets of the treated paper were placed immediately into the Mylar® bag with the pieces of insulation and the bag was sealed. The samples were maintained in the sealed bags for 72 hours at ambient conditions. The insulation was then removed from the sealed bags and was tested without the scavenger-treated paper in the DMC (Dynamic Micro Chamber) for formaldehyde emissions with the test conditions as described previously.

The product formaldehyde emissions were measured immediately upon removal from the respective bags. The Control exhibited a formaldehyde emission level of 49.8 ppb; while the formaldehyde scavenger-treated sample exhibited a formaldehyde emission level of 12.3 ppb, a reduction of over 75%.

EXAMPLE 7

Treatment of Insulation with Formaldehyde Scavenger-Paper

This Example illustrates the use of a disposable formaldehyde scavenger-treated paper to scavenge formaldehyde emissions from a commercially available R-19 unfaced fiberglass insulation blanket product.

A fresh bag of Knauf R-19 insulation was obtained directly from Knauf Fiberglass. An entire batt was rolled as tightly as possible and put into a Mylar® bag that was approximately 23" wide×30" high. Two pieces (sheets) of 12"×12" paper were placed inside the bag. The sheets of paper were placed between the outside of the rolled batt and the inside wall of the Mylar® bag and then the bags were sealed.

For the Control sample, sheets of the paper were used without any scavenger treatment. For the formaldehyde scavenger-treated sample, the sheets of paper were prepared by spraying with 39.2 grams and 36.1 grams respectively of a 33.3% sodium bisulfite solution. Each of the treated paper sheets was dried in an oven for 4 minutes at 105° C. The treated papers were placed immediately into the Mylar® bag with the compressed fiberglass insulation batt and the bag was sealed.

The samples were maintained in the sealed bags for 72 hours at ambient conditions. The insulation was removed from the sealed bag and then promptly tested—without the scavenger-treated paper—in the DMC (Dynamic Micro Chamber) for formaldehyde emissions as described previously.

The Control sample exhibited a formaldehyde emission level of 55.5 ppb; while the formaldehyde scavenger-treated sample exhibited a formaldehyde emission level of 2.2 ppb, a reduction of over 95%. This Example shows that a formaldehyde scavenger-treated paper can be effective to significantly reduce formaldehyde emissions in a formaldehyde-emitting fiberglass insulation product in blanket form.

EXAMPLE 8

Formaldehyde Scavenger-Treated Paper in Duct Board

An examination of the effect of a formaldehyde scavenger-treated sheet material on formaldehyde emissions from duct board was conducted.

A fresh bag of duct board (Knauf) was obtained locally from Shook and Fletcher Insulation Company (Atlanta, Ga.).

In what was believed to be approximately 4 months after the manufacturing date of the insulation the following samples were prepared.

A control piece of duct board was removed from the box and immediately sealed in a plastic bag marked control. The remaining pieces of duct board were treated in the box with disposable scavenger paper made by treating Taskmate wiper product 29112 (Georgia-Pacific LLC, Atlanta, Ga.) with a 40% solution of sodium bisulfite and drying. Pieces of the formaldehyde scavenger-treated paper were cut to 4'×16". Three of these pieces were placed below, between, and on top of the pieces of duct board in the box such that all surfaces of the duct board were covered top and bottom with 3 pieces of the disposable scavenger paper. The box was sealed with packing tape and allowed to sit for 7 days.

On Day 8, the box of treated duct board was opened. Control and treated samples were placed into Mylar bags, sealed, and sent to a testing laboratory for analysis. The product formaldehyde emissions were measured in an environmental chamber using ASTM D5116.

Upon opening the box of duct board, the Drager CMS detector with a 0.4 ppm-10 ppm sulfur dioxide chip was used to measure any sulfur dioxide emissions released upon opening the box of treated duct board.

Product formaldehyde emissions measured according to ASTM 5116

| Hours in Small Chamber | Control Emissions $\mu g/m^2$-hr | FORMALDEHYDE SCAVENGER-Treated $\mu g/m^2$-hr |
|---|---|---|
| 24 | 91 | 0 |
| 168 | 55 | 15 |
| 336 | 50 | 23 |
| 672 | | 20 |

It is well known that product formaldehyde emissions can be predicted by extrapolating via a power curve function. Accordingly, the emissions for the duct board were extrapolated out to 10,000 hours (approximately 1 year) to understand how the treated samples compare to a control over an extended period of time. Results are shown in FIG. 9.

| Drager CMS with sulfur dioxide chip measurements of sulfur dioxide emitted | |
|---|---|
| Air sampling description | ppm sulfur dioxide as measured by Drager CMS |
| Positioned Drager tester approximately 2 inches from treatment paper on top surface exposed in box immediately upon opening box. | 2.52 ppm |
| Positioned Drager tester approximately 2.5 feet from treatment paper on top surface exposed in box immediately upon opening box. | 0.78 ppm |
| Removed paper and duct board from box. Cut a 12" × 12" piece of duct board. Positioned Drager tester approximately 2 inches from duct board. | <0.4 ppm |

Note:
The TWA (time weighted average) for sulfur dioxide is 2 ppm. The STEL (short term exposure limit) for sulfur dioxide is 5 ppm.

The data in this experiment show the following:

Treating the duct board with disposable scavenger paper reduced formaldehyde emissions significantly.

It would take a control sample approximately 1 year to decay to the emissions level of the treated sample measured at just 1 month.

Drager CMS measurements indicate that worker exposure to sulfur dioxide emissions upon opening box of duct board treated with sodium bisulfite treated paper and installing duct board will not be a problem.

EXAMPLE 9

Formaldehyde Scavenger Addition on Molded Insulation

An examination was conducted to determine the effect of disposable scavenger paper on formaldehyde emissions from molded insulation. Results showed that formaldehyde emissions were reduced significantly by treating the samples with disposable scavenger paper.

Fresh samples of molded insulation were obtained directly from Knauf fiberglass. Samples were sealed and transported in plastic.

On Day 1 samples were prepared. The pieces of molded insulation approximately ⅜" thick were cut to 8"×20" pieces.

Pieces of disposable scavenger papers were prepared by spraying 7"×20" papers with approximately 6.5 grams of a 33% sodium bisulfite solution. The papers were dried for 1 minute at 105° C. in a suitable oven.

The molded insulation pieces were treated in a Mylar bag with the disposable scavenger papers. Pieces of scavenger paper were placed below, between, and on top of the pieces of molded insulation in the Mylar bag such that all surfaces of the molded insulation were covered top and bottom with pieces of the disposable scavenger paper. The bag was sealed with packing tape and allowed to sit for 7 days.

On Day 8 the bag of treated molded was opened. The product formaldehyde emissions were measured in an environmental chamber conforming to ASTM D5116.

| Product formaldehyde emissions measured by ASTM D 5116 | | |
|---|---|---|
| Hours in Small Chamber at AQS | Control Emissions $\mu g/m^2$-hr | Caire Treated $\mu g/m^2$-hr |
| 4 | | 1.8 |
| 8 | | 2.4 |
| 24 | 32 | 3.6 |
| 48 | 25 | 4.5 |
| 72 | | 5.0 |
| 96 | 19 | 5.4 |
| 120 | 18 | |
| 144 | 17 | |

The above data show that treating the molded insulation with disposable formaldehyde scavenger-treated sheet material reduced formaldehyde emissions significantly.

These results are shown graphically in FIG. 10.

EXAMPLE 10

Gaseous Formaldehyde Scavenger-Treated Blowing Wool

This Example shows a further result of using formaldehyde scavenger on blowing wool, where the formaldehyde scavenger was sulfur dioxide.

A control sample was prepared by placing 135 grams of the Advanced ThermaCube Plus® (hereinafter ATC+) blowing wool into a large Zipper-type bag. The bag then was sealed tightly.

To prepare a treated sample, 135 grams of the ATC+blowing wool also was placed into a large zipper-type bag and then sulfur dioxide, as a gaseous formaldehyde scavenger, was filled into the bag (the intent was to replace all of the gas in the bag with sulfur dioxide) and the bag was sealed tightly.

The product formaldehyde emissions were measured in the DMC (Dynamic Micro Chamber) using the Ceq test three days after the samples were prepared. The DMC testing parameters were as set forth previously.

| Product Formaldehyde Emissions Results Using Sulfur Dioxide As FORMALDEHYDE SCAVENGER | |
|---|---|
| Sample | ppb HCHO |
| Control E | 270 |
| Treated Sample E-1 | N.D. |

The above Example demonstrates that sulfur dioxide is an effective formaldehyde for blowing wool.

EXAMPLE 11

Levels of Sulfur Dioxide as Formaldehyde Scavenger on Blowing Wool A Control was prepared by placing 135 grams of Advanced ThermaCube Plus® (hereinafter ATC+) blowing wool into a 1 L Nalgene bottle and sealed.

Treated samples were prepared by also putting 135 grams of ATC+ blowing wool into a 1 L Nalgene bottle. Sulfur dioxide (120 cubic centimeters STP) was injected into the bottom of the bottle using a hypodermic needle and the bottle was sealed. Three concentrations of sulfur dioxide were used, pure (100%), 10% (by volume in nitrogen) and 1% (by volume in nitrogen).

The product formaldehyde emissions were measured four (4) days later in the DMC (Dynamic Micro Chamber) using the Ceq test, using the protocol as described previously.

The results comparing the level of formaldehyde emissions from the Control and the various treated samples are presented in the following Table.

| Product Formaldehyde Emissions Results | |
|---|---|
| Sample | ppb HCHO |
| Control | 338 |
| 100% sulfur dioxide - 120 ccs | N.D. |
| 10% sulfur dioxide - 120 ccs | ND |
| 1% sulfur dioxide - 120 ccs | 254 |

EXAMPLE 12

Levels of Sulfur Dioxide as Formaldehyde Scavenger on Blowing Wool Using Injection The procedure of Example 12 was repeated, except that the treated samples were prepared by injecting a gas containing 10% by volume sulfur dioxide in nitrogen into the bottom of the 1 L Nalgene bottle using a hypodermic needle and the bottle was sealed. Four (4) treated samples were prepared using 5, 10, 20 and 40 cubic centimeters (STP) of the gas for the respective treatments. The DMC Ceq results comparing the level of formaldehyde emission from the control sample to the emission form the treated samples are presented in the following Table.

| Product Formaldehyde Emissions Results | |
|---|---|
| Sample | ppb HCHO |
| Control | 150 |
| 10% sulfur dioxide - 5 ccs | 232 |
| 10% sulfur dioxide - 10 ccs | 173 |
| 10% sulfur dioxide - 20 ccs | 91 |
| 10% sulfur dioxide - 40 ccs | 35 |

This Example shows that injection of a gaseous formaldehyde scavenger can provide effective reduction of formaldehyde emissions from a formaldehyde-emitting binder when a suitable amount of formaldehyde scavenger is present in the system.

EXAMPLE 13

Blowing Wool with Gaseous Formaldehyde Scavenger Addition

Four commercial plastic bags of Owens Corning Advanced ThermaCube Plush loosefill insulation (e.g., blowing wool) were obtained directly from Owens Corning in Fairburn, Ga. Each bag contained approximately 35 pounds of compressed blowing wool product. The bags were not air tight but, rather, included several holes over the surface of the bag. As mentioned previously, commercial bags of insulation include holes to allow insertion of the insulation for packaging, shipping, and storage.

One bag was retained as a Control. The other three bags were treated by injecting gaseous sulfur dioxide into the as-is bags using an injector. The sulfur dioxide was injected into the bags through a needle that pierced the bag wall. The sulfur dioxide injections were conducted in a climate-controlled room that had a volume of 28.32 $m^3$ and an air exchange rate 0.5 air exchanges per hour, i.e., every hour ½ of the volume of air in the room is exchanged.

The first test bag was provided with a single injection of approximately 1 liter (STP) of sulfur dioxide (approximately 2.9 g) with the output of the injection needle located at the center of the bag. The second test bag was injected with approximately 2 liters (STP) of sulfur dioxide (approximately 5.7 g) using two one liter injections spaced equidistant from the sides of the bag. The third test bag was also injected twice to provide a total of approximately 5 liters (STP) of sulfur dioxide (approximately 14.3 g), using one injection of 2 liters and one injection of 3 liters both positioned at the center of the bag. Immediately after the injections, a commercially available Drager Chip Measurement System (CMS) detector (available from Draeger Safety, Inc.) fitted with an sulfur dioxide chip designed to measure sulfur dioxide in the 0.4 ppm to 10.0 ppm range was used to measure any sulfur dioxide in the control room in the vicinity of the bag treatment assembly. The detector did not measure any sulfur dioxide during the first and second bag filling operations. There was a slight odor of sulfur dioxide following the injection of 5 liters in the third test, but no measurement of the actual concentration was in the environment was made.

All four bags were then stored under ambient conditions. After eight days, each back was brought individually into the control room for analysis of residual sulfur dioxide and formaldehyde emission testing. The first and third treated bags were opened and the Drager tester was used again to measure sulfur dioxide in the air in the vicinity of the blowing wool insulation. There was no detectable residue of sulfur dioxide from the first test bag. Multiple measurements were taken with the third test bag. The Drager CMS recorded sulfur dioxide levels in the 0.4 to 2.76 ppm range in connection with the third bag. Samples of the insulation, including a sample from the control bag, were transferred to Nalgene bottles for formaldehyde and corrosion testing. Specifically, about 135 grams of insulation were placed into 1 liter Nalgene bottles.

Product formaldehyde emissions then were measured in the Dynamic Micro Chamber (DMC) using the equilibrium (Ceq) test protocol as discussed elsewhere herein.

The control sample and the treated samples also were tested for corrosivity to see if any of the sulfur dioxide had been converted to corrosive sulfuric acid. The corrosion test involved placing 50 grams of blowing wool insulation into a plastic container and then inserting the plastic container into a desiccator containing 50 grams water. A cleaned metal coupon was placed directly on top of the insulation. The desiccators were sealed and then stored in an oven for 4 days at 49° C. Photographs were taken of control samples and the treated samples. No difference was seen between coupons exposed to control insulation versus insulation treated with 1 liter of sulfur dioxide.

| Product Formaldehyde Emissions Results | |
|---|---|
| Sample | DMC Formaldehyde Emissions ppb formaldehyde |
| Control | 129.9 |
| Treated Sample - 1 L sulfur dioxide | N.D. |

N.D. = Non-Dectectable

EXAMPLE 14

Blowing Wool with Solid Formaldehyde Scavenger Addition

This Example illustrates the results of the addition of a formaldehyde scavenger in a solid (neat) form according to the present invention to a product having a cured formaldehyde-emitting binder thereon. In this case, a commercially available blowing wool product (Owens Corning Advanced ThermaCube Plus® blowing wool (loose fill fiberglass) was encased in a substantially air-tight container or package with a formaldehyde scavenger composition.

A Control was prepared by closely placing 135 grams of the Advanced ThermaCube Plus® (hereinafter ATC+) blowing wool into a one liter Nalgene® bottle. The bottle then was sealed by closing the lid tightly. Two other control samples were similarly prepared.

To prepare a treated sample, 135 grams of the ATC+ blowing wool also was stuffed into a one liter Nalgene® bottle with 0.81 grams sodium bisulfite scavenger powder. The insulation was divided into 5 equal parts before inserting it not the bottle. One part (⅕ of the porous fiberglass material) was placed into the Nalgene bottle then 0.2 grams bisulfite was sprinkled into the bottle. This layering procedure of blowing wool and scavenger was continued until there were 5 layers of blowing wool insulation and 4 interspersed layers of bisulfite. Layers were alternated to maximize dispersion of bisulfite into insulation. The bottle then was sealed by closing the lid tightly. Two other treated samples were similarly prepared.

After approximately six days, the formaldehyde emissions of one of the control and one of the treated samples were measured in the DMC (Dynamic Micro Chamber) using the Ceq test, using the same procedure described earlier in Example 3. The results are in the Table below as Control and Treated sample.

Product Formaldehyde Emissions Results

| Sample | Ppb HCHO |
|---|---|
| Control A | 350 |
| Treated Sample A-1 | N.D. |

N.D. means non-detectable.

The remaining two control and treated samples were sealed in separate Mylar sample bags and were delivered next day to AQS in Marietta, Ga. The two control samples and treated samples were respectively consolidated into one sample for testing. The product formaldehyde emissions were measured by AQS in their small chambers in accordance with ASTM D5116. The results obtained by AQS are shown in the Table below and are presented graphically in FIG. 11.

AQS Small Chamber Data
Product Formaldehyde Emissions from ATC+
Hours in Small Chamber at AQS:

| | 6 | 24 | 48 | 72 | 96 | 168 |
|---|---|---|---|---|---|---|
| Control | 238 | 215 | 255 | 209 | 198 | 140 |
| Caire Treated | BQL | BQL | BQL | BQL | BQL | BQL |

Note:
These results above are single data points.
BQL = Below Quantifiable Levels The present invention has been described with reference to specific embodiments. However, this application is intended to cover those changes and substitutions that may be made by those skilled in the art without departing from the spirit and the scope of the invention. Unless otherwise specifically indicated, all percentages are by weight. Throughout the specification and in the claims the term "about" is intended to encompass + or −5%.

What is claimed is:

1. A method of reducing formaldehyde emissions while retaining tensile strength properties in a porous fiberglass insulation material, comprising:

providing a first porous fiberglass insulation material comprising a formaldehyde-emitting binder; and applying at time equals zero minutes a formaldehyde scavenger overspray to the first porous fiberglass insulation material;

wherein:

the first porous fiberglass insulation material comprises formaldehyde-emissions in need of scavenging and a density of less than about 350 kg/m$^3$, the binder is substantially cured prior to applying the formaldehyde scavenger overspray, and the formaldehyde scavenger consists essentially of a sulfite, a bisulfite, or a sulfur compound with a valence state other than +6.

2. The method of claim 1, further comprising at about 100 hours after time equals zero minutes comparing the formaldehyde emissions of the first porous fiberglass insulation material to the formaldehyde emissions of a second porous fiberglass insulation material, wherein the second porous fiberglass insulation material comprises the same substantially cured binder and has approximately the same density as the first porous fiberglass insulation material, wherein at a time immediately prior to time equals zero, the second porous fiberglass insulation material comprises approximately the same amount of formaldehyde emissions in need of scavenging as the first porous fiberglass insulation material, and wherein the first and second porous fiberglass insulation materials are aged under the conditions form time equals zero to the time when the emissions of the first and second porous fiberglass insulation materials are compared.

3. The method of claim 2, wherein the formaldehyde emissions of the first porous fiberglass insulation material are substantially reduced as compared to the formaldehyde emissions of the second porous fiberglass insulation material.

4. The method of claim 1, wherein the overspray comprises a neat formaldehyde scavenger in the form of a solid, gas, or liquid.

5. The method of claim 1, wherein the overspray comprises an aqueous solution, wherein the formaldehyde scavenger is present in the solution at from about 1 to about 50 wt. percent, as measured by total weight of the solution, and wherein the aqueous solution is applied to the porous fiberglass material at from about 1 to about 200 weight percent, as measured by total weight of the binder solids in the porous fiberglass material.

6. The method of claim 1, wherein the overspray comprises the solid, and wherein the overspray is applied at from about 1 to about 75 weight percent, as measured by weight of the binder solids in the porous fiberglass insulation material.

7. The method of claim 1, wherein the overspray comprises gas, and wherein the overspray is applied at from about 0.01 to about 10 weight percent, as measured by weight of the binder solids in the porous fiberglass material,

8. The method of claim 1, wherein the porous fiberglass insulation material is selected from the group consisting of blowing wool insulation, batt insulation, rolled insulation, pipe insulation, duct board insulation and molded insulation.

9. The method of claim 1, wherein the formaldehyde scavenger is sulfur dioxide.

10. The method of claim 9, wherein the sulfur dioxide is injected into a package containing the porous fiberglass material, wherein the package comprises one or more holes.

11. The method of claim 1, wherein the formaldehyde scavenger consists essentially of a sulfite or a bisulfite.

12. The method of claim 1, wherein the formaldehyde scavenger consists essentially of a sulfite.

* * * * *